US008111235B2

(12) United States Patent
Baba et al.

(10) Patent No.: US 8,111,235 B2
(45) Date of Patent: Feb. 7, 2012

(54) IMAGE DISPLAY APPARATUS

(75) Inventors: Masahiro Baba, Kanagawa (JP); Goh Itoh, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1008 days.

(21) Appl. No.: 12/042,028

(22) Filed: Mar. 4, 2008

(65) Prior Publication Data

US 2009/0002285 A1 Jan. 1, 2009

(30) Foreign Application Priority Data

Jun. 28, 2007 (JP) ..... 2007-170623

(51) Int. Cl.
*G09G 3/36* (2006.01)

(52) U.S. Cl. ..... 345/102; 345/77; 345/89; 345/204; 345/690

(58) Field of Classification Search ..... 345/76–83, 345/89–102, 204, 214, 690
See application file for complete search history.

(56) References Cited

U.S. PATENT DOCUMENTS

| | | | | |
|---|---|---|---|---|
| 6,941,013 | B1 * | 9/2005 | Drayer | 382/168 |
| 7,199,776 | B2 * | 4/2007 | Ikeda et al. | 345/89 |
| 7,522,135 | B2 * | 4/2009 | Baik | 345/88 |
| 2003/0107586 | A1 * | 6/2003 | Takiguchi et al. | 345/629 |
| 2005/0035974 | A1 * | 2/2005 | Nair et al. | 345/589 |
| 2005/0184952 | A1 * | 8/2005 | Konno et al. | 345/102 |
| 2006/0119612 | A1 * | 6/2006 | Kerofsky et al. | 345/590 |
| 2006/0139270 | A1 * | 6/2006 | Hong et al. | 345/87 |
| 2006/0221046 | A1 * | 10/2006 | Sato et al. | 345/102 |
| 2006/0274062 | A1 * | 12/2006 | Zhang et al. | 345/420 |
| 2007/0001997 | A1 * | 1/2007 | Kim et al. | 345/102 |
| 2007/0268242 | A1 | 11/2007 | Baba et al. | |
| 2008/0074372 | A1 | 3/2008 | Baba et al. | |
| 2008/0106544 | A1 * | 5/2008 | Lee et al. | 345/214 |

FOREIGN PATENT DOCUMENTS

| | | |
|---|---|---|
| JP | 2001-027890 | 1/2001 |
| JP | 2005-148710 | 6/2005 |
| WO | WO 2005093703 A1 * | 10/2005 |

OTHER PUBLICATIONS

A. Konno, et al., RGB Color Control System for LED Backlights in IPS-LCD TVs, SID Simposium Digest, vol. 36, pp. 1380-1383, 2005.

* cited by examiner

*Primary Examiner* — Lun-Yi Lao
*Assistant Examiner* — Gregory J Tryder
(74) *Attorney, Agent, or Firm* — Turocy & Watson, LLP

(57) ABSTRACT

An image display apparatus includes an image display unit having a light source and a light modulating unit; a histogram generating unit; a function generating unit; a first brightness calculating unit; a second brightness calculating unit; a first difference calculating unit; a first multiplying unit; a first summation calculating unit; a first brightness gradient calculating unit; a second brightness gradient calculating unit; a second difference calculating unit; a second multiplying unit; a second summation calculating unit; a weighted linear sum calculating unit; a determination unit; a control parameter selecting unit; and a control unit.

21 Claims, 17 Drawing Sheets

FIG. 5

| GRAY-SCALE LEVEL x | BRIGHTNESS G(x) |
|---|---|
| 0 | 0.000000 |
| 1 | 0.000005 |
| 2 | 0.000023 |
| 3 | 0.000057 |
| ⋮ | ⋮ |
| 252 | 0.974300 |
| 253 | 0.982826 |
| 254 | 0.991393 |
| 255 | 1.000000 |

FIG. 6

| GRAY-SCALE LEVEL x | BRIGHTNESS GRADIENT G'(x) |
|---|---|
| 0 | 0.000000 |
| 1 | 0.000011 |
| 2 | 0.000026 |
| 3 | 0.000042 |
| ⋮ | ⋮ |
| 252 | 0.008506 |
| 253 | 0.008546 |
| 254 | 0.008587 |
| 255 | 0.008627 |

FIG. 8

| GRAY-SCALE LEVEL x | BRIGHTNESS g(x, 0.1) | BRIGHTNESS g(x, 0.2) | BRIGHTNESS g(x, 0.3) | | BRIGHTNESS g(x, 0.9) | BRIGHTNESS g(x, 1.0) |
|---|---|---|---|---|---|---|
| 0 | 0.000400 | 0.000800 | 0.001200 | | 0.003600 | 0.004000 |
| 1 | 0.000401 | 0.000801 | 0.001202 | | 0.003605 | 0.004005 |
| 2 | 0.000402 | 0.000805 | 0.001207 | | 0.003621 | 0.004023 |
| 3 | 0.000406 | 0.000811 | 0.001217 | | 0.003651 | 0.004057 |
| | | | | | | |
| 252 | 0.097440 | 0.194881 | 0.292321 | | 0.876963 | 0.974403 |
| 253 | 0.098289 | 0.196579 | 0.294868 | | 0.884605 | 0.982895 |
| 254 | 0.099143 | 0.198285 | 0.297428 | | 0.892285 | 0.991427 |
| 255 | 0.100000 | 0.200000 | 0.300000 | | 0.900000 | 1.000000 |

FIG. 9

| GRAY-SCALE LEVEL x | BRIGHTNESS GRADIENT g'(x, 0.1) | BRIGHTNESS GRADIENT g'(x, 0.2) | BRIGHTNESS GRADIENT g'(x, 0.3) | | BRIGHTNESS GRADIENT g'(x, 0.9) | BRIGHTNESS GRADIENT g'(x, 1.0) |
|---|---|---|---|---|---|---|
| 0 | 0.000000 | 0.000000 | 0.000000 | | 0.000000 | 0.000000 |
| 1 | 0.000001 | 0.000002 | 0.000003 | | 0.000010 | 0.000011 |
| 2 | 0.000003 | 0.000005 | 0.000008 | | 0.000023 | 0.000026 |
| 3 | 0.000004 | 0.000008 | 0.000013 | | 0.000037 | 0.000042 |
| | | | | | | |
| 252 | 0.000847 | 0.001694 | 0.002542 | | 0.007625 | 0.008472 |
| 253 | 0.000851 | 0.001702 | 0.002554 | | 0.007661 | 0.008512 |
| 254 | 0.000855 | 0.001711 | 0.002566 | | 0.007697 | 0.008553 |
| 255 | 0.000859 | 0.001719 | 0.002578 | | 0.007734 | 0.008593 |

FIG.10

| GRAY-SCALE LEVEL x | BRIGHTNESS g (x, 1.0) |
|---|---|
| 0 | 0.004000 |
| 1 | 0.004005 |
| 2 | 0.004023 |
| 3 | 0.004057 |
| ⋮ | ⋮ |
| 252 | 0.974403 |
| 253 | 0.982895 |
| 254 | 0.991427 |
| 255 | 1.000000 |

FIG.11

| GRAY-SCALE LEVEL x | BRIGHTNESS GRADIENT g' (x, 1.0) |
|---|---|
| 0 | 0.000000 |
| 1 | 0.000011 |
| 2 | 0.000026 |
| 3 | 0.000042 |
| ⋮ | ⋮ |
| 252 | 0.008472 |
| 253 | 0.008512 |
| 254 | 0.008553 |
| 255 | 0.008593 |

FIG.14

| INPUT GRAY-SCALE LEVEL x | OUTPUT GRAY-SCALE LEVEL $f_0(X)$ | OUTPUT GRAY-SCALE LEVEL $f_1(X)$ | OUTPUT GRAY-SCALE LEVEL $f_2(X)$ | | OUTPUT GRAY-SCALE LEVEL $f_8(X)$ | OUTPUT GRAY-SCALE LEVEL $f_9(X)$ |
|---|---|---|---|---|---|---|
| 0 | 0 | 0 | 0 | | 0 | 0 |
| 1 | 2 | 2 | 2 | | 1 | 1 |
| 2 | 4 | 4 | 3 | | 2 | 2 |
| 3 | 6 | 5 | 5 | | 3 | 3 |
| | | | | | | |
| 252 | 255 | 255 | 254 | | 252 | 252 |
| 253 | 255 | 255 | 254 | | 253 | 253 |
| 254 | 255 | 255 | 255 | | 254 | 254 |
| 255 | 255 | 255 | 255 | | 255 | 255 |

IMAGE DISPLAY APPARATUS

CROSS-REFERENCE TO RELATED APPLICATIONS

This application is based upon and claims the benefit of priority from the prior Japanese Patent Application No. 2007-170623, filed on Jun. 28, 2007; the entire contents of which are incorporated herein by reference.

BACKGROUND OF THE INVENTION

1. Field of the Invention

The present invention relates to an image display apparatus and a method which achieve enhancement of visual contrast of displayed images.

2. Description of the Related Art

In recent yeas, an image display apparatus provided with a light source and a light modulating device that modulates the intensity of light from the light source is widely used. A representative example is a liquid crystal display apparatus. However, in these image display apparatuses, the light modulating device does not have ideal modulation characteristics. Therefore, lowering of contrast caused by light leak from the light modulating device occurs especially when black image is displayed.

In order to improve the lowering of contrast, a plurality of methods in which luminance modulation of the light source in accordance with input image, conversion of gray-scales of the respective pixels of the input image, that is, gamma conversion, are combined are proposed.

For example, in SID Symposium Digest Vol. 38, pp. 1381, the luminance of a backlight and gamma conversion are determined on the basis of the highest gray-scale level of the input image.

In Japanese Patent No. 3215388, the luminance of the backlight and the gamma conversion are determined on the basis of the lowest gray-scale level, the highest gray-scale level, and the average gray-scale level of the input image.

Both of the technologies in the related art enable better amplification of the contrast by controlling the luminance of the light source and the gamma conversion of the input image in accordance with the input image in comparison with image display apparatuses on the basis of a constant light source luminance.

The both of the technologies in the related art control the light source luminance and the gamma conversion on the basis of representative values such as an average gray-scale level, a most frequent gray-scale level and a peak gray-scale level of the input image.

However, images which are significantly different in gray-scale distribution even though these representative values are the same exist in abundance, and there is a problem that sufficient contrast of the input image cannot be obtained since the same light source luminance and the gamma conversion are set up for all the images in the related art.

In view of such circumstances, it is an object of the invention to provide an image display apparatus and a method which achieve further enhancement of visual contrast of input images.

BRIEF SUMMARY OF THE INVENTION

According to embodiments of the present invention, there is provided an image display apparatus including: an image display unit having a light source configured to be able to adjust the light source luminance in n steps from dark luminance to bright luminance and a light modulating unit configured to display an image by modulating the transmittance or the reflectance of light from the light source on the basis of an input image signal; a histogram generating unit configured to generate a histogram which correlates representative gray-scale levels which are representatives of respective gray-scale level ranges divided at every predetermined number of gray-scale levels in one frame of an input image to frequencies of pixels included in the respective gray-scale level ranges; a function generating unit configured to generate predetermined m types of gray-scale level conversion functions for converting predetermined j preset gray-scale levels into output gray-scale levels which can be displayed by the light modulating unit; a first brightness calculating unit configured to calculate predetermined values of first brightness of the respective j preset gray-scale levels; a second brightness calculating unit configured to calculate second values of brightness to be displayed on the image display unit at the respective output gray-scale levels obtained by converting the respective preset gray-scale levels in each combination of the j preset gray-scale levels, the n steps of light source luminance and the m types of gray-scale level conversion functions; a first difference calculating unit configured to calculate first differences between the first values of brightness and the second values of brightness in each combination of the j preset gray-scale levels, the n steps of light source luminance and the m types of gray-scale level conversion functions; a first multiplying unit configured to calculate first products multiplying the first differences by the frequencies for the respective representative gray-scale levels corresponding to the preset gray-scale levels used for calculating the first differences; a first summation calculating unit configured to calculate first evaluation values, which are sums of the first products for the all j preset gray-scale levels; a first brightness gradient calculating unit configured to calculate predetermined values of first brightness gradient of the respective j preset gray-scale levels; a second brightness gradient calculating unit configured to calculate second values of brightness gradient to be displayed on the image display unit at the respective output gray-scale levels obtained by converting the respective preset gray-scale levels in each combination of the j preset gray-scale levels, the n steps of light source luminance and the m types of gray-scale level conversion functions; a second difference calculating unit configured to calculate second differences between the first values of brightness gradient and the second values of brightness gradient in each combination of the j preset gray-scale levels, the n steps of light source luminance and the m types of gray-scale level conversion functions; a second multiplying unit configured to calculate second products multiplying the second differences by the frequencies for the respective representative gray-scale levels corresponding to the preset gray-scale levels used for calculating the second differences; a second summation calculating unit configured to calculate second evaluation values, which are sums of the second products for the all j preset gray-scale levels; a weighted linear sum calculating unit configured to calculate weighted linear sums of the first evaluation values and the second evaluation values in each combination of the n steps of light source luminance and the m types of gray-scale level conversion functions; a determination unit configured to determine the weighted linear sum which is equal to or smaller than a predetermined threshold value or the minimum value from among the respective weighted linear sums; a control parameter selecting unit configured to select an optimum light source luminance and an optimal gray-scale level conversion function corresponding to the determined weighted linear sum; and a control unit configured to provide a converted image converted from the input image by the optimum gray-scale level conversion function to the light modulating unit and set the light source to emit light at the optimum light source luminance for one frame of the input image.

According to the embodiments of the invention, the visual contrast of the input image can further be enhanced.

BRIEF DESCRIPTION OF THE DRAWINGS

FIG. 5 shows first contents of a first lookup table;

FIG. 6 shows second contents of the first lookup table;

FIG. 8 shows third contents of the first lookup table;

FIG. 9 shows fourth contents of the first lookup table;

FIG. 10 shows fifth contents of the first lookup table;

FIG. 11 shows sixth contents of the first lookup table;

FIG. 14 shows contents of the second lookup table;

DETAILED DESCRIPTION

First Embodiment

Referring now to FIG. 1 to FIG. 17, an image display apparatus 10 according to a first embodiment of the invention will be described.

(1) Configuration of Image Display Apparatus 10

Figure 1:
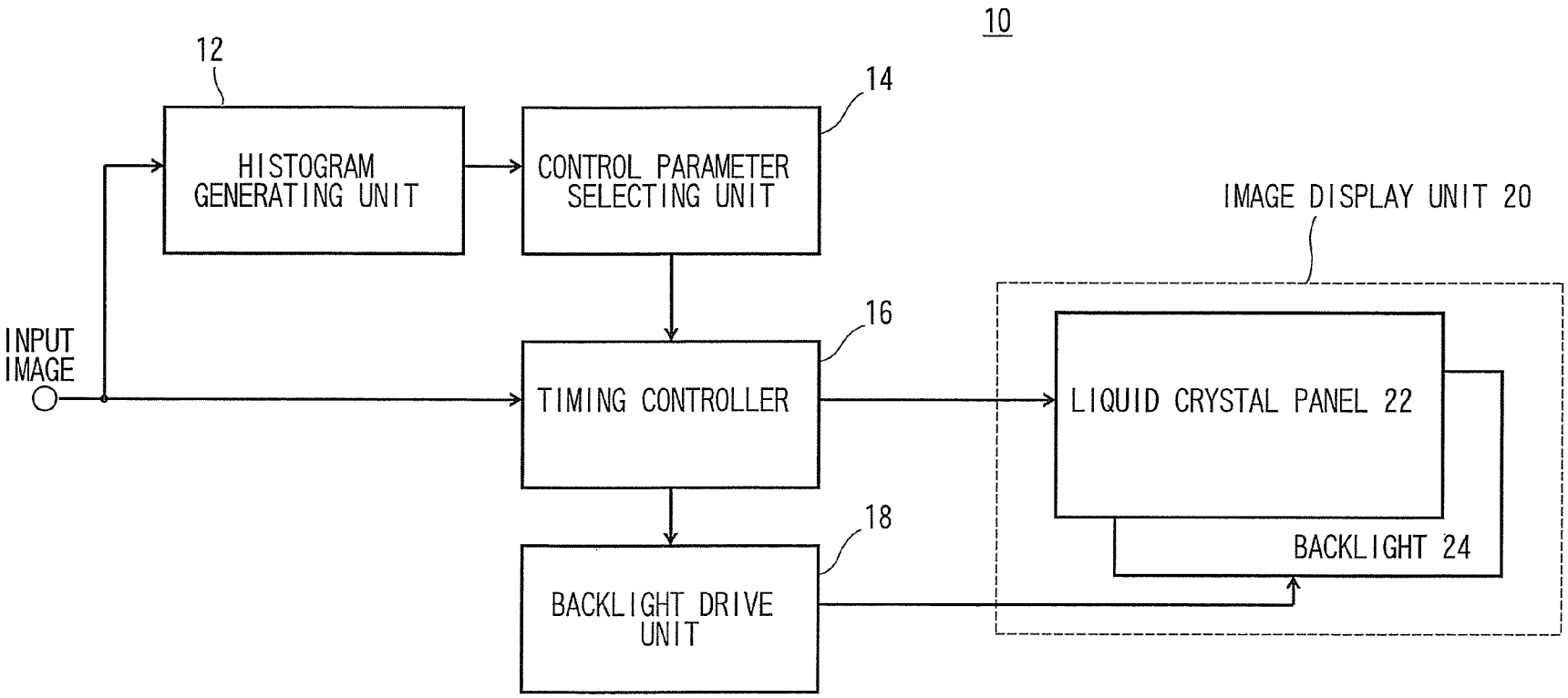
FIG. 1 is a block diagram of an image display apparatus according to a first embodiment of the invention.

FIG. 1 shows a configuration of the image display apparatus 10 according to the first embodiment.

The image display apparatus 10 includes a histogram generating unit 12, a control parameter selecting unit 14, a timing controller 16 as a control unit, a backlight drive unit 18 and an image display unit 20.

The image display unit 20 includes a liquid crystal panel 22 as a light modulating unit and a backlight 24 as a light source installed on the back side of the liquid crystal panel 22.

The input image is supplied to the histogram generating unit 12 and the timing controller 16.

The histogram generating unit 12 counts the number of pixels included in each of predetermined gray-scale level ranges in the input image and generates a histogram showing the representative gray-scale levels of each respective gray-scale level ranges in a one-to-one correspondence with the numbers of pixels included in the respective gray-scale level ranges (the number of pixels is an example of the frequency of the pixels).

The control parameter selecting unit 14 selects a luminance of the backlight 24 (luminance of a light source) and a gray-scale level conversion function (gamma conversion function) to be carried out for the respective pixels of the input image on the basis of the histogram generated by the histogram generating unit 12.

The timing controller 16 carries out the gamma conversion for the input image with the gray-scale level conversion function selected by the control parameter selecting unit 14, and then adjusts synchronization of the converted image after having subjected to the gamma conversion with the backlight luminance selected by the control parameter selecting unit 14. The converted image is sent to the liquid crystal panel 22 together with the synchronizing signal for driving the liquid crystal panel 22, and the backlight luminance signal is sent to the backlight drive unit 18.

In the backlight drive unit 18 generates a backlight drive signal for actually driving and controlling the backlight 24 on the basis of the entered backlight luminance and sends it to the backlight 24.

The image display unit 20 writes the conversion image on the liquid crystal panel 22 and, simultaneously, the backlight 24 emits light on the basis of the backlight drive signal outputted from the backlight drive unit 18, so that an image is displayed on the liquid crystal panel 22.

Operations of the respective units 12 to 20 will be described in detail below.

(2) Histogram Generating Unit 12

The histogram generating unit 12 counts the number of pixels included in each of predetermined gray-scale level ranges in the input image and generates a histogram showing the representative gray-scale levels of each respective gray-scale level range in a one-to-one correspondence with the frequencies (the numbers of pixels) included in the respective gray-scale level ranges.

Although various types of the input images are supposed, in the first embodiment, the input image is composed of three channels of red, green and blue (hereinafter, referred to simply as RGB input image), and the histogram generating unit 12 generates a single histogram without discriminating the respective channels.

Modifications of the histogram generating unit 12 include the followings.

(2-1) Modification 1

As Modification 1, the histogram may include values normalized by the total number of pixels, for example, as shown below in addition to the frequency.

$$h_n(x) = \frac{h(x)}{\sum_{i=0}^{255} h(i)} \tag{1}$$

where $h_n(x)$ is the frequency normalized by the total number of pixels of the preset gray-scale level x, and h(x) is the frequency of the preset gray-scale level x.

(2-2) Modification 2

As Modification 2, the histogram may be generated using the largest gray-scale level of each pixel from among the three channels of red, green and blue (hereinafter, referred to as RGB gray-scale levels).

(2-3) Modification 3

In a case in which the type of the input image is composed of three channels of Y, Cb and Cr (hereinafter referred to as Y Cb Cr input image), which are composed of the luminance and the color difference signal, a configuration to generate the histogram of Y, which is a luminance channel, may be employed.

(2-4) Modification 4

A configuration to generate the histogram as described above after having converted the Y Cb Cr input image into the RGB image according to the expression 2 may also be employed.

$$\begin{bmatrix} R \\ G \\ B \end{bmatrix} = \begin{bmatrix} 1.0000 & 0.0000 & 1.4020 \\ 1.0000 & -0.3441 & -0.7141 \\ 1.0000 & 1.7720 & 0.0000 \end{bmatrix} \begin{bmatrix} Y \\ Cb-128 \\ Cr-128 \end{bmatrix} \quad (2)$$

where Y, Cb and Cr are values of the luminance and the color difference signal normalized into 8-bits, and R, G and B are values of the image signal composed of three channels of red, green and blue normalized into 8-bits.

The expression 2 is an example of conversion, and other coefficients of conversion may also be used.

(2-5) Modification 5

In contrast to the examples shown above, a configuration to convert the RGB input image into the value of the Y channel using the expression 3 to generate the histogram may also be employed.

$$Y=0.299R+0.587G+0.114B \quad (3)$$

(2-6) Modification 6

As Modification 6, a configuration to generate a plurality of histograms may be employed.

For example, a histogram employing the largest gray-scale level from among the RGB gray-scale levels of each pixel is used as a histogram used in a first evaluation value calculating step described later is assumed to be, and a histogram generated without discriminating the RGB gray-scale levels of each pixel is used as a histogram used in a second evaluation value calculating step is also employed.

Figure 2:
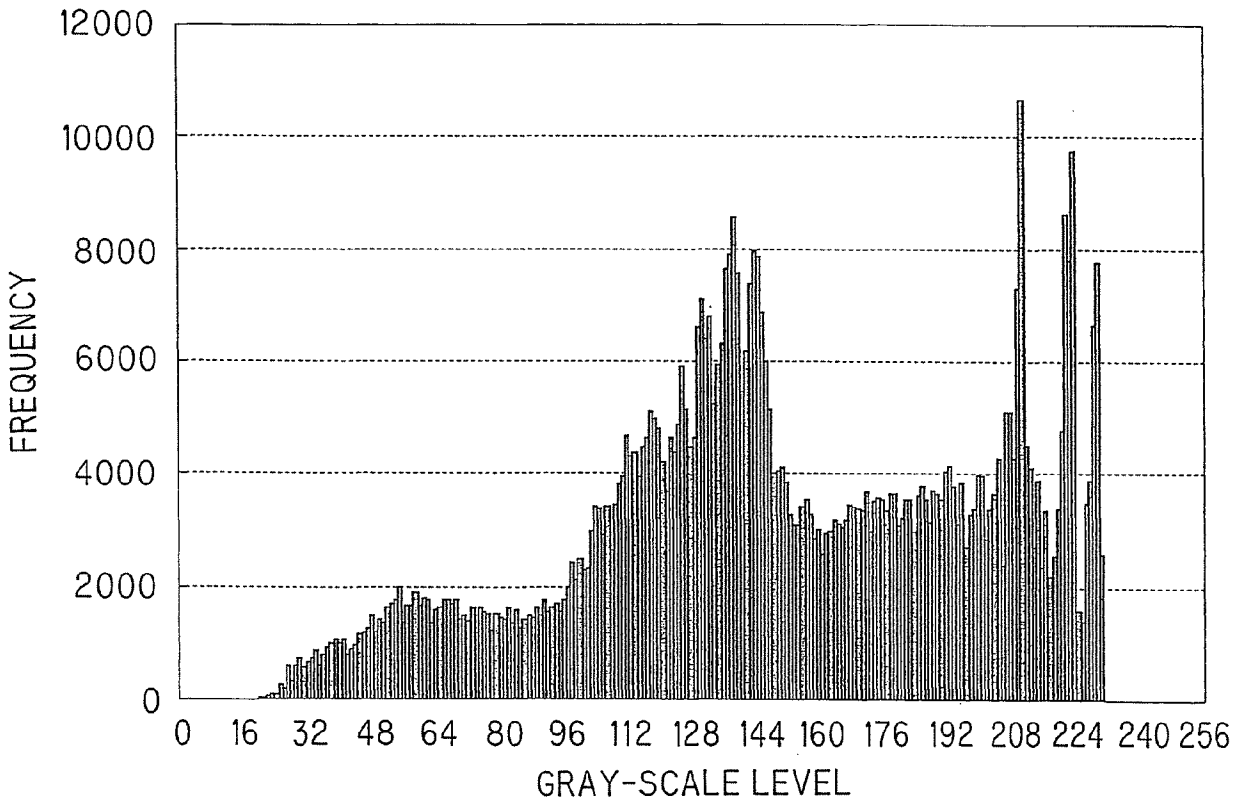
FIG. 2 is a histogram showing the relation between the frequency and the gray-scale level.

When RGB channels of the input image is 8-bit gray-scale levels, a frequency distribution from 0 to 255 is obtained as shown in FIG. 2 by counting the frequency of each gray-scale level and detecting the histogram.

(2-7) Modification 7

A configuration in which the detection of the histogram is executed for each respective gray-scale level range in order to save the amount of memory for storing the histogram or to save the amount of processing for the detection of the histogram in addition to the configuration to calculate the frequency for every gray-scale level as shown in FIG. 2 is also employed.

Figure 3:
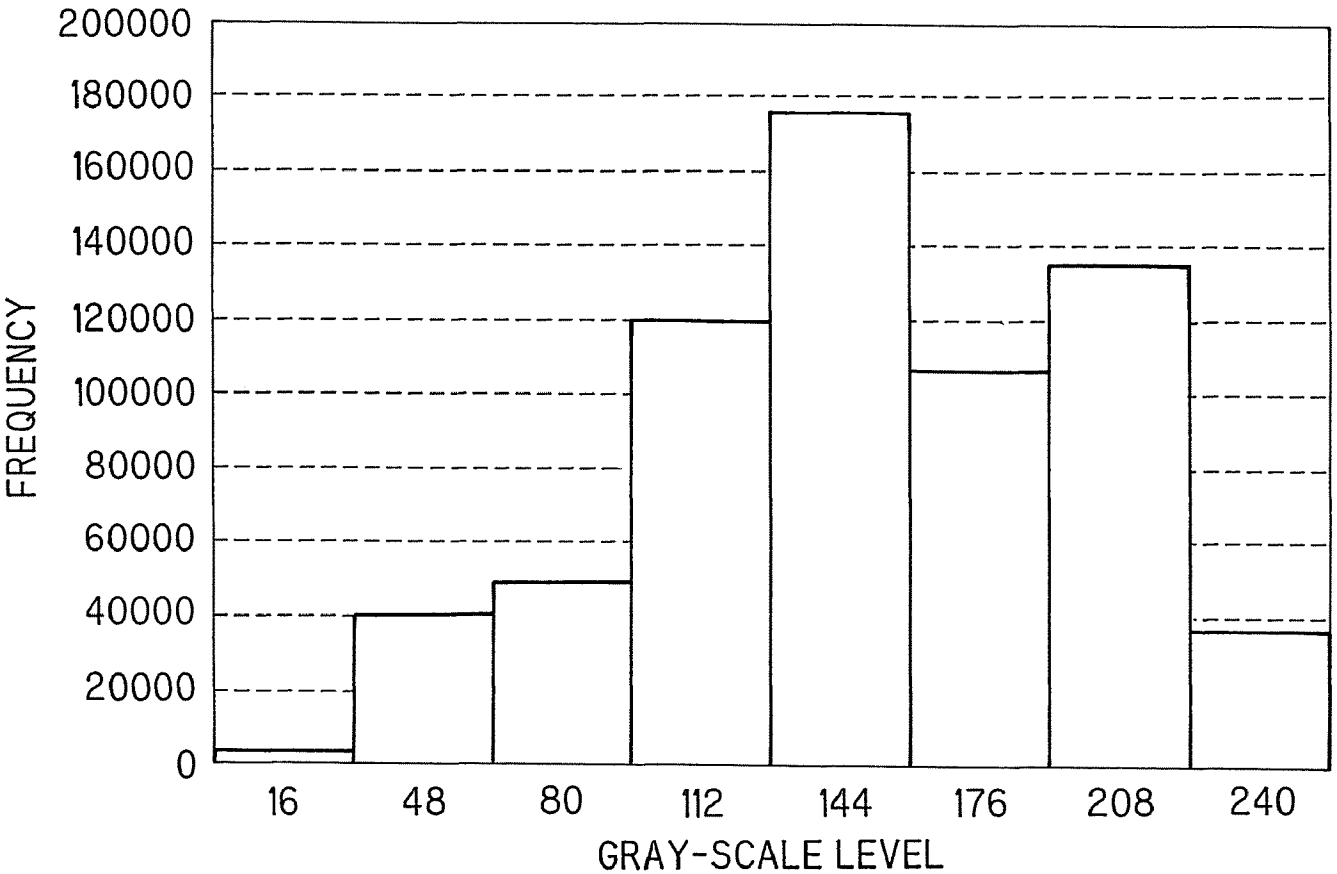
FIG. 3 is a histogram showing the relation between the frequency and the gray-scale level in a discretized pattern.

For example, FIG. 3 shows an example of the result of histogram detection for the ranges divided by every 32 gray-scale levels. When the gray-scale levels of the input image is 8-bit, the input image is expressed by the higher 3 bits by setting zero to the lower 5 bits in binary expression, and hence the gray-scale levels each including 32 gray-scale levels are obtained.

The each gray-scale ravel range (for example, from 0 to 31) may be represented by a median value within the corresponding range. For example, in the case of the example in FIG. 3, the range from 0 to 31 gray-scale levels is represented by 16 gray-scale level, and the range from 32 to 63 gray-scale levels is represented by the 48 gray-scale level.

A configuration in which only a part of the gray-scale levels of the histogram is detected in order to further save the amount of calculation and the memory may also be employed. For example, a configuration to detect the histogram for all the gray-scale levels, then calculate gray-scale values having its average value, median value, and highest frequency, and set 0 to the frequencies of the gray-scale levels other than these gray-scale levels may also be employed.

(2-8) Conclusion

The histogram detected through the processes described above is entered to the control parameter selecting unit 14. In other words, the frequencies h(x) for the ranges divided by every gray-scale level of x in one frame of the input image are outputted.

(3) Control Parameter Selecting Unit 14

The control parameter selecting unit 14 calculates the backlight luminance and the gray-scale level conversion function on the basis of the histogram detected by the histogram generating unit 12.

Figure 4A:
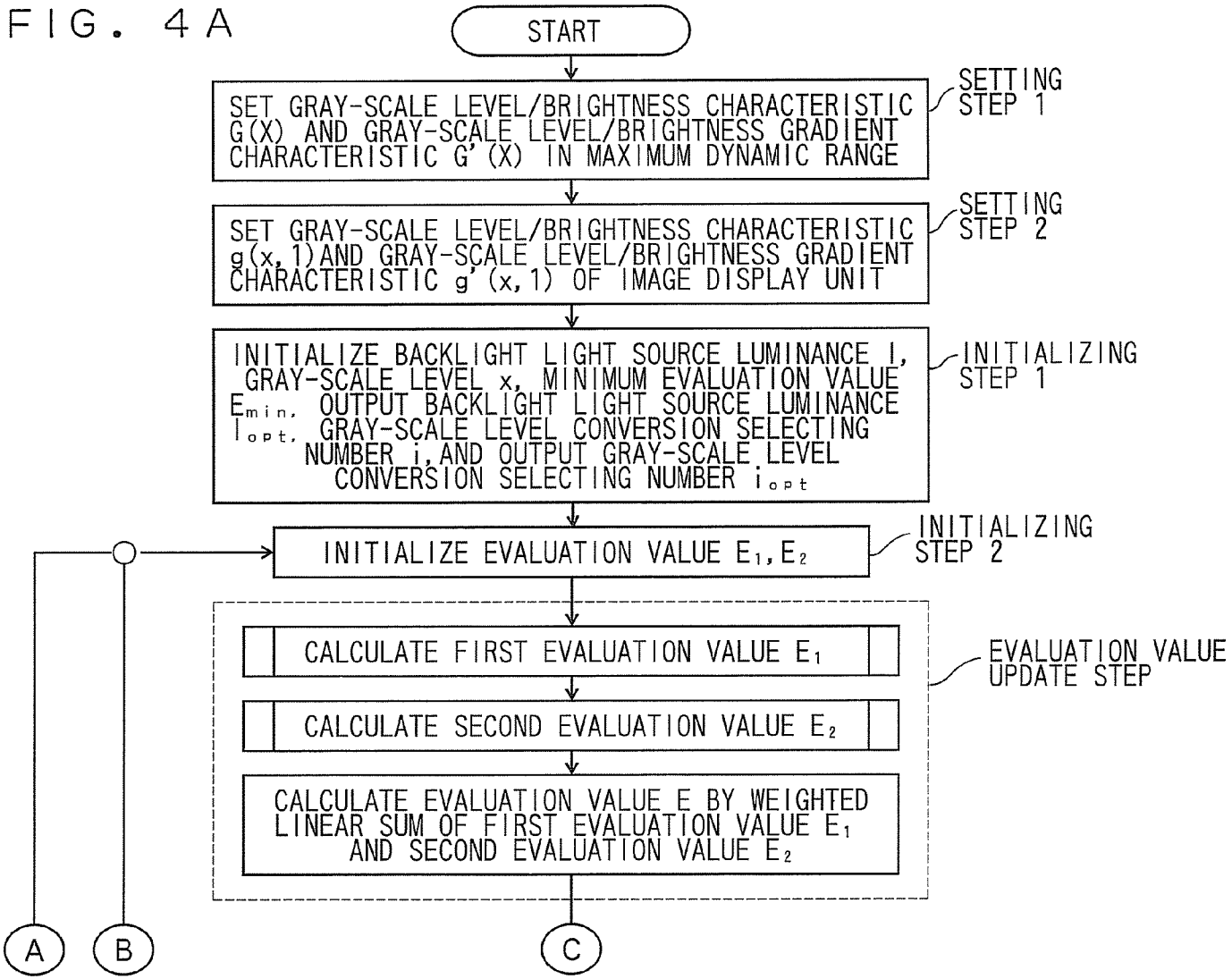
FIG. 4 is a flowchart of a control parameter selecting unit.
Figure 4B:
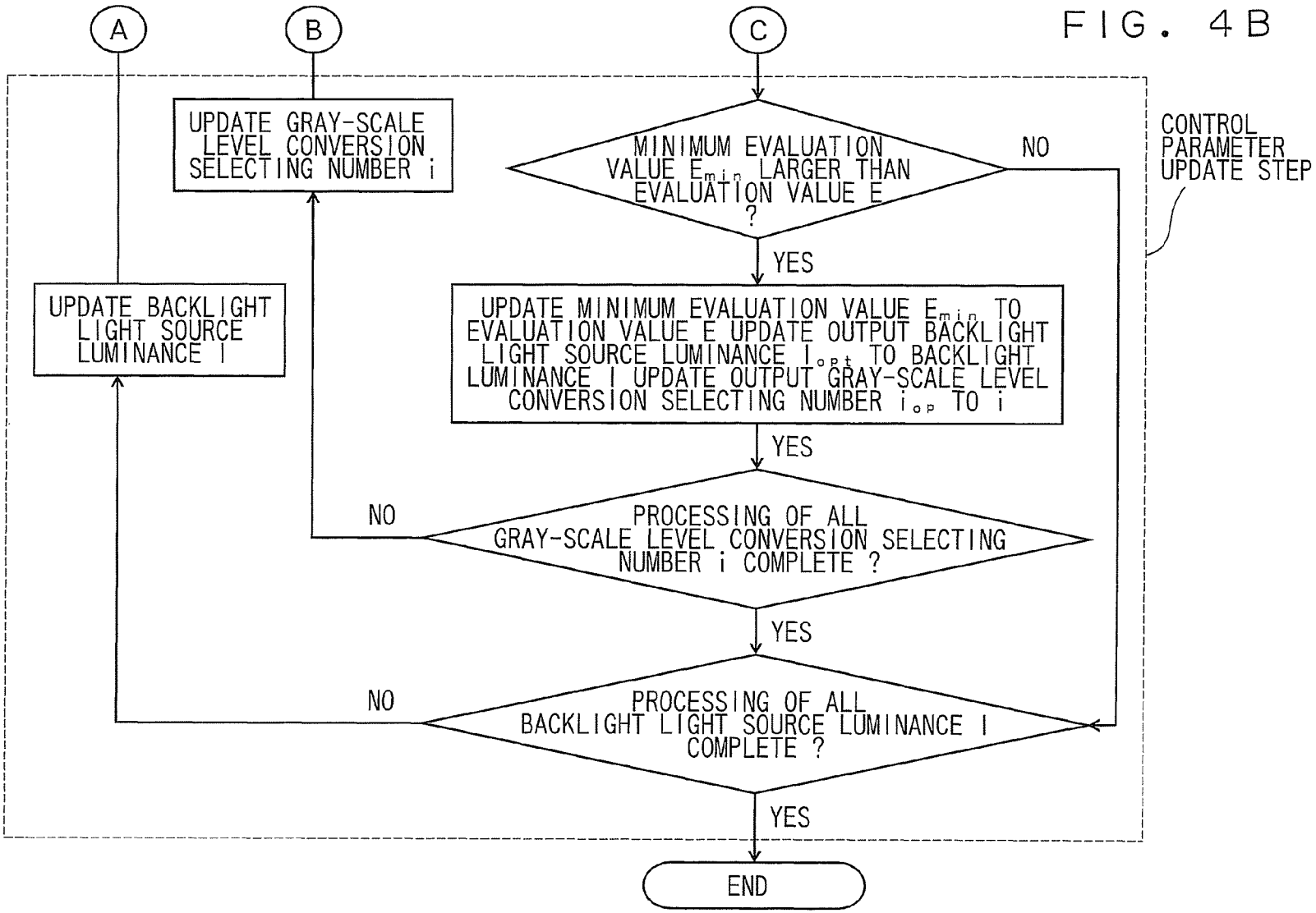

Referring now to a flowchart shown in FIG. 4, a method of calculating the backlight luminance and a method of calculating the gray-scale conversion function will be described in detail.

(3-1) Setting Step 1

In Setting Step 1, a gray-scale level/brightness characteristic which is wanted to be displayed on the image display unit 20 and a gray-scale level/brightness gradient characteristic are set. In other words, the relations of the gray-scale level/brightness characteristic and the gray-scale level/brightness gradient characteristic are set, which are the most ideal when displaying the image on the image display unit 20, are set in advance.

(3-1-1) Setting of Maximum Dynamic Range

A maximum dynamic range of the image display unit 20 is set to the control parameter selecting unit 14 in advance.

For example, the ideal maximum dynamic range having a maximum value of 1 and a minimum value of 0 is expressed as in Expression 4.

$$D_{min}=0$$

$$D_{max}=1 \quad (4)$$

where $D_{min}$ and $D_{max}$ are the minimum value and the maximum value of the maximum dynamic range to be displayed on the image display unit 20, respectively.

The maximum dynamic range may also be set as in Expression 5 on the basis of the luminance modulation range of the backlight luminance and the characteristics of the liquid crystal panel 22 which are set in advance.

$$D_{min}=T_{min}I_{min}$$

$$D_{max}=T_{max}I_{max} \quad (5)$$

where $I_{min}$ and $I_{max}$ are the minimum value and the maximum value of the backlight luminance modulation range, respectively, and $T_{min}$ and $T_{max}$ are the minimum transmittance and the maximum transmittance of the liquid crystal panel 22, respectively.

Since the $I_{min}$, $I_{max}$, $T_{min}$, $T_{max}$ may be relative values, the value of $I_{min}$ may be set as a relative value for $I_{max}=1$ and the value of $T_{min}$ may be set as a relative value for $T_{max}=1$.

Analytically, the maximum dynamic range is expressed as Expression 5.

However, actually, a measured luminance of the image display unit 20 with the minimum displayable gray-scale level of the liquid crystal panel 22 ("0" in the case of the liquid crystal panel 22 which is able to express in 8-bit) and illumination with the minimum backlight luminance in the luminance modulation range of the backlight 24 is set to the minimum displayable display luminance $D_{min}$ of the image display unit 20.

Likewise, a measured luminance of the image display unit 20 with the maximum possible gray-scale level of the liquid crystal panel 22 ("255" in the case of the liquid crystal panel 22 which is able to express in 8-bit) and illumination with the maximum backlight luminance in the luminance modulation range of the backlight 24 is set to the maximum possible display luminance $D_{max}$ of the image display unit 20.

The maximum display luminance $D_{max}$ is normalized to 1 and the minimum display luminance when $D_{max}$ is normalized to 1 may be set to $D_{min}$.

(3-1-2) Setting of Gray-Scale Level/Brightness Characteristic

Subsequently, the gray-scale level/brightness characteristic in the maximum dynamic range obtained through the procedure shown above will be set.

When the brightness corresponds to the luminance, the gray-scale level/luminance characteristic is analytically calculated by Expression 6.

$$G(x) = \left(\frac{x}{255}\right)^{\gamma}(D_{\max} - D_{\min}) + D_{\min} \tag{6}$$

where x is the gray-scale level expressed in 8-bit, γ is a gamma value used for correcting the input image. The gamma value generally used is 2.2.

Expression 6 expresses the gray-scale level/luminance characteristic. However, since the brightness sensitivity characteristic of human being is proportional to the logarithm of luminance, the gray-scale level/brightness characteristic may be substituted by a gray-scale level/logarithmic luminance characteristic as in Expression 7.

$$G_{\log}(x) = \frac{\log(G(x))}{\log(G(255))} \tag{7}$$

A gray-scale level/lightness value characteristic may be employed using the lightness value defined in a uniform color space.

$$G_{L^*}(x)=G(x)^{1/3} \tag{8}$$

The lightness value is standardized by CIE (International Commission on Illumination) in a narrow sense, and is changed nonlinearly in a dark luminance. However, in Expression 8, it is expressed as a simple form, which is in proportion to that raised to the $1/3^{th}$ power of luminance.

(3-1-3) Setting of Gray-Scale Level/Brightness Gradient Characteristic

Subsequently, the gray-scale/brightness gradient characteristic in the maximum dynamic range is set.

The gray-scale level/brightness gradient characteristic corresponds to a first order differential of the gray-scale level/brightness characteristic. In other words, when the brightness corresponds to the luminance, the gray-scale level/brightness gradient characteristic is analytically calculated as in Expression 9.

$$G'(x) = \frac{d}{dx}G(x) = \frac{\gamma}{255}\left(\frac{x}{255}\right)^{\gamma-1}(D_{\max} - D_{\min}) \tag{9}$$

It is also possible to employ the gray-scale level/lightness value gradient characteristic as shown in Expression 10 using the lightness value in which the brightness is defined in the uniform color space.

$$G'_{L^*}(x) = \frac{d}{dx}G_{L^*} = \frac{\gamma}{3}\cdot\frac{1}{255}\left(\frac{x}{255}\right)^{\frac{\gamma}{3}-1}(D_{\max} - D_{\min}) \tag{10}$$

(3-1-4) Preparation of Lookup Table Data

The gray-scale level/brightness characteristic and the gray-scale level/brightness gradient characteristic may be calculated using Expressions 6 to 10. However, the following configuration is also applicable.

For example, a lookup table data including the preset gray-scale levels x in a one-to-one correspondence with the values of brightness G (x) from the relation between the preset gray-scale level x and the brightness G(x) with the values of $D_{min}$ and $D_{max}$ fixed is prepared. In the same manner, a lookup table data including the preset gray-scale levels x in a one-to-one correspondence with the values of brightness gradient G' (x) is prepared. An example of the table data of the gray-scale level/brightness characteristic is shown in FIG. 5 and an example of the table data of the gray-scale level/brightness gradient characteristic is shown in FIG. 6.

Figure 7:
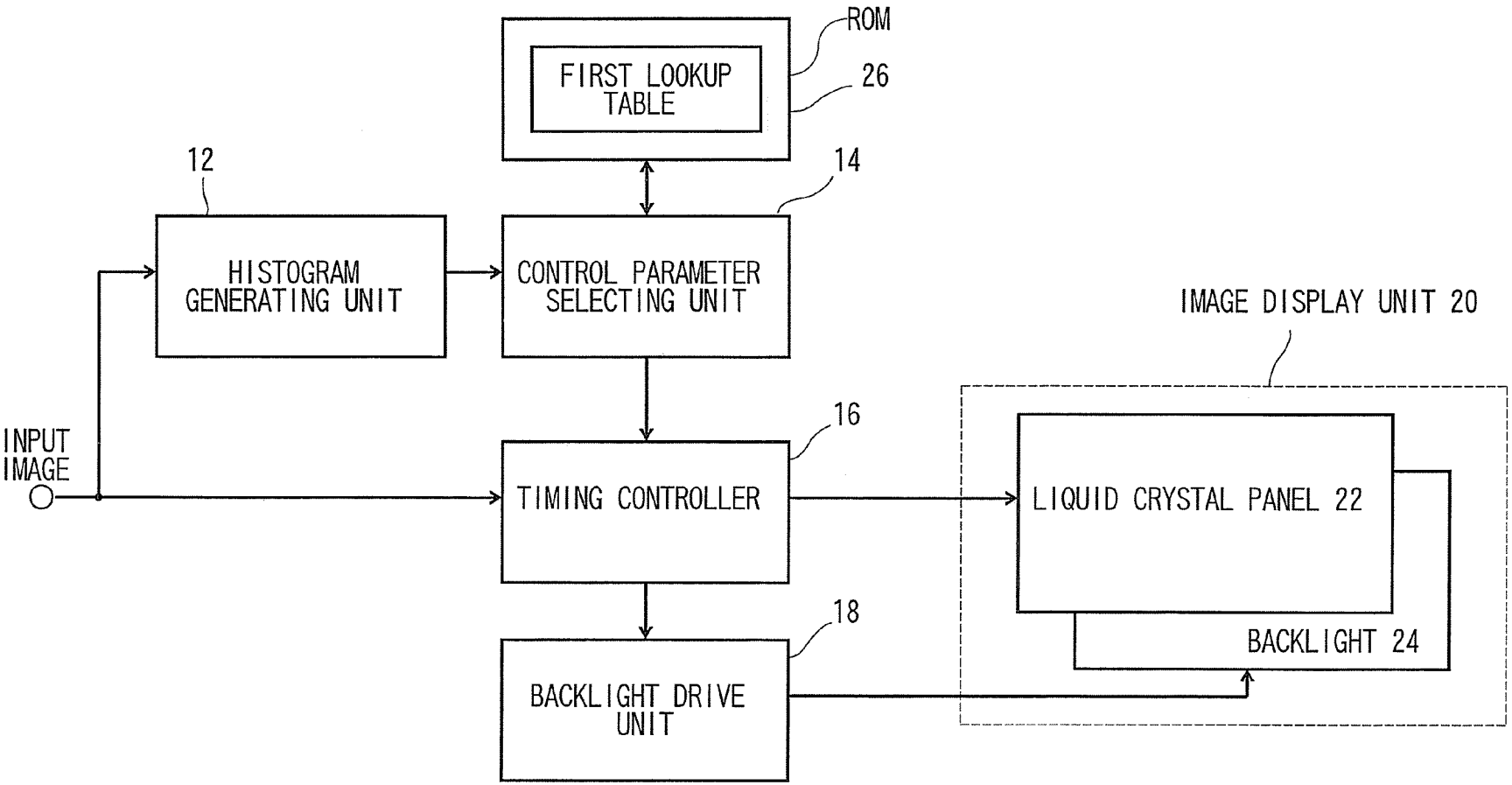
FIG. 7 is a block diagram of the image display apparatus with the first lookup table added thereto.

The prepared table data is stored in a ROM (Read Only Memory) or the like which is accessible by the control parameter selecting unit 14 as a first lookup table 26 as shown in FIG. 7.

When obtaining the brightness of the respective gray-scale levels, the brightness corresponding to the preset gray-scale level x is obtained by referring to the ROM for the preset gray-scale level x. When obtaining the brightness gradient of the respective gray-scale level, the brightness gradient corresponding to the preset gray-scale level x is obtained by referring to the ROM for the preset gray-scale level x.

When there are a plurality of $D_{min}$ and $D_{max}$ prepared, and the combination of the $D_{min}$ and $D_{max}$ is changed, for example, by the user's instruction, a plurality of table data according to the respective combinations may be prepared to refer the table data of the preset combination.

(3-2) Setting Step 2

In Setting Step 2, the gray-scale level/brightness characteristic and the gray-scale level/brightness gradient characteristic of the actual image display unit 20 are set.

(3-2-1) Setting of Dynamic Range

The dynamic range of the image display unit 20 at a certain backlight luminance I is expressed as in Expression 11.

$$d_{min}(I)=T_{min}I$$

$$d_{max}(I)=T_{max}I \tag{11}$$

where, $d_{min}$(I) and $d_{max}$ (I) are the minimum and maximum values of the dynamic range displayable on the image display unit 20 at a backlight luminance I, respectively.

Analytically, the dynamic range of the image display unit 20 is expressed as in Expression 11.

However, actually, a measured luminance of the image display unit 20 with the minimum displayable gray-scale level of the liquid crystal panel 22 ("0" in the case of the liquid crystal panel 22 which is able to express in 8-bit) and illumination with the backlight luminance I is set to the minimum displayable display luminance $d_{min}$ of the image display unit 20 at the backlight luminance I.

Likewise, a measured luminance of the image display unit 20 with the maximum possible gray-scale level of the liquid crystal panel 22 ("255" in the case of the liquid crystal panel 22 which is able to express in 8-bit) and illumination with the backlight luminance I is set to the maximum possible display luminance $d_{max}$ of the image display unit 20 at the backlight luminance I.

It is also possible to set the normalized minimum display luminance to $d_{min}(I)$ and the normalized maximum display luminance to $d_{max}(I)$ when the $d_{max}(I_{max})$ is normalized to "1".

(3-2-2) Setting of Gray-Scale Level/Brightness Characteristic

Subsequently, the gray-scale level/brightness characteristic of the image display unit 20 at the backlight luminance I is set.

When the brightness corresponds to the luminance, the gray-scale level/luminance characteristic of the image display unit 20 (in general referred to as gamma characteristic) is analytically expressed as in Expression 12.

$$g(x, I) = \left(\frac{x}{255}\right)^{\Gamma}(d_{\max}(I) - d_{\min}(I)) + d_{\min}(I) \tag{12}$$

where, x is the gray-scale level expressed in 8-bit, Γ is a gamma value used for correcting the liquid crystal panel 22. The gamma value generally used is 2.2.

Expression 12 expresses the gray-scale level/luminance characteristic. However, since the brightness sensitivity characteristic of human being is proportional to the logarithm of luminance, the gray-scale level/brightness characteristic may be substituted by a gray-scale level/logarithmic luminance characteristic as in Expression 13.

$$g_{\log}(x, I) = \frac{\log(g(x, I))}{\log(g(255, I_{\max}))} \tag{13}$$

A gray-scale level/lightness value characteristic may be employed using the lightness value defined in a uniform color space.

$$g_{L^*}(x,I)=g(x,I)^{1/3} \tag{14}$$

As in Expression 8, the lightness value in Expression 14 is expressed as a simple form, which is in proportion to that raised to the $1/3^{th}$ power of luminance.

(3-2-3) Setting of Gray-Scale Level/Brightness Gradient Characteristic

Subsequently, the gray-scale level/brightness gradient characteristic of the image display unit 20 at the backlight luminance I is set.

When the brightness corresponds to the luminance, the gray-scale level/brightness gradient characteristic of the image display unit 20 is analytically calculated as in Expression 15.

$$g'(x, I) = \frac{d}{dx}g'(x, I) = \frac{\Gamma}{255}\left(\frac{x}{255}\right)^{\Gamma-1}(d_{\max}(I) - d_{\min}(I)) \tag{15}$$

It is also possible to employ the gray-scale level/lightness value gradient characteristic as shown in Expression 16 using the lightness value in which the brightness is defined in the uniform color space.

$$\begin{aligned} g'_{L^*}(x, I) &= \frac{d}{dx}g'_{L^*}(x, I) \\ &= \frac{\Gamma}{3}\cdot\frac{1}{255}\left(\frac{x}{255}\right)^{\frac{\Gamma}{3}-1}(d_{\max}(I) - d_{\min}(I)) \end{aligned} \tag{16}$$

(3-2-4) Preparation of Lookup Table Data

The gray-scale level/brightness characteristic and the gray-scale level/brightness gradient characteristic may be calculated using Expressions 12 to 16. However, the following configuration is also applicable.

For example, a lookup table data including the correspondence of the preset gray-scale level x, the backlight luminance I, and the brightness g (x, I) from the relation between the preset gray-scale level x, the backlight luminance I, and the brightness g(x, I) with dm (I) and $d_{max}(I)$ fixed is prepared. In the same manner, a lookup table data including the correspondence of the preset gray-scale level x, the backlight luminance I, and the brightness gradient g'(x, I) from the relation between the preset gray-scale level x, the backlight luminance I, and the brightness gradient g'(x, I) is prepared. An example of the table data of the gray-scale level/brightness characteristic is shown in FIG. 8 and an example of the table data of the gray-scale level/brightness gradient characteristic is shown in FIG. 9.

The table data in FIG. 8 has the correspondence of the gray-scale level and the brightness with respect to the data having the backlight luminance at an increment of 0.1 from 0.1 to 1.0.

The table data in FIG. 9 has the correspondence of the gray-scale level the brightness gradient with respect to the data having the backlight luminance at an increment of 0.1 from 0.1 to 1.0.

The prepared table data is stored in a ROM (Read Only Memory) or the like which is accessible by the control parameter selecting unit 14 as shown in FIG. 7.

When obtaining the brightness of the respective gray-scale levels, the brightness corresponding to the preset gray-scale level x at the backlight brightness I is obtained by referring to the ROM for the preset gray-scale level x and the backlight luminance I. When obtaining the brightness gradient of the respective gray-scale level, the brightness gradient corresponding to the preset gray-scale level x at the backlight brightness I is obtained by referring to the ROM for the preset gray-scale level x and the backlight luminance I.

The table data in FIG. 8 and FIG. 9 have the gray-scale level/brightness characteristic and the gray-scale level/brightness gradient characteristic with respect to each backlight luminance I. However, as shown in FIG. 10 and FIG. 11, it is also possible to provide only the gray-scale level/brightness characteristic and the gray-scale level/brightness gradient characteristic at the backlight luminance $I_{max}$ (=1.0), and to execute proportion calculation for the brightness at the backlight luminance $I_{max}$ for other values of backlight luminance.

(3-2-5) Others

Setting Step 1 and Setting Step 2 have to be carried out once at the beginning (for example, when the power of the image display apparatus 10 is turned ON) and do not have to be carried out for every frame of the input image.

When the gray-scale level/brightness characteristic and the gray-scale level/brightness gradient characteristic are stored in advance as the table data, Setting Step 1 and Setting Step 2 may be omitted.

(3-3) Initializing Step 1

In Initializing Step 1, variables used for the following process are initialized.

For example, the process as in Expression 17 is executed.

$$I \leftarrow I_{min}$$

$$x \leftarrow 0$$

$$E_{min} \leftarrow \text{MAX_VAL}$$

$$I_{opt} \leftarrow I$$

$$i \leftarrow 0$$

$$i_{opt} \leftarrow i \tag{17}$$

where $E_{min}$ is a minimum evaluation value used in a control parameter update step, described later, $I_{opt}$ is the backlight luminance which is finally fixed, i is an output gray-scale level conversion selection number for selecting one of a plurality of preset gray-scale level conversion functions $f_i(x)$ for an input preset gray-scale level x, described later, $I_{opt}$ is an output gray-scale level conversion selection number which is finally fixed, a sign← means to substitute a value on the right-hand side to the left-hand side, and MAX_VAL is a maximum value that the evaluation value E, described later can take.

Figure 12:
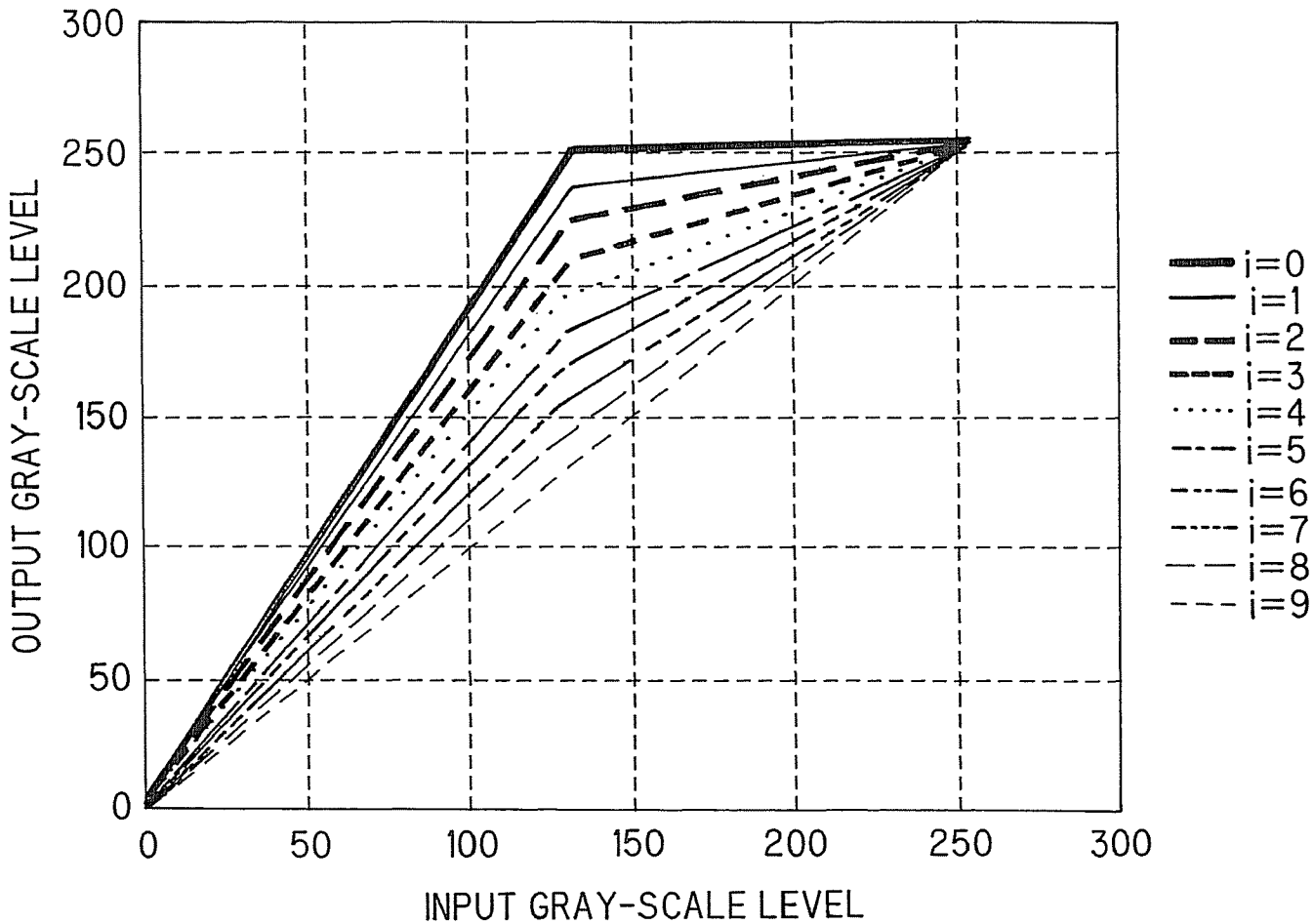
FIG. 12 is a graph showing the relation of gray-scale level conversion functions.

In the first embodiment, the gray-scale level conversion functions $f_i(x)$ include ten types of gray-scale level conversion functions as shown in FIG. 12. The input gray-scale level x here is a gray-scale level of an image signal which is wanted to be displayed, and the output gray-scale level $f_i(x)$ is a gray-scale level which is displayable on the liquid crystal panel 22.

In FIG. 12, the gray-scale level conversion functions are independent from the backlight luminance I, however, the configuration of the gray-scale level conversion functions may be possible that the different gray-scale level conversion functions are prepared for each backlight luminance. In such a case, the gray-scale level conversion function is expressed in a form of a function of the preset gray-scale level x and the backlight luminance I such as $f_i(x, I)$.

The gray-scale level conversion function $f_i(x)$ can be obtained by calculation in the interior of the control parameter selecting unit 14. However, in the first embodiment, the table data including the input preset gray-scale levels x in one-to-one correspondence with the output gray-scale level functions (conversion gray-scale level functions) $f_i(x)$ is stored in the ROM as a second lookup table 28 as shown in FIG. 13.

Figure 13:
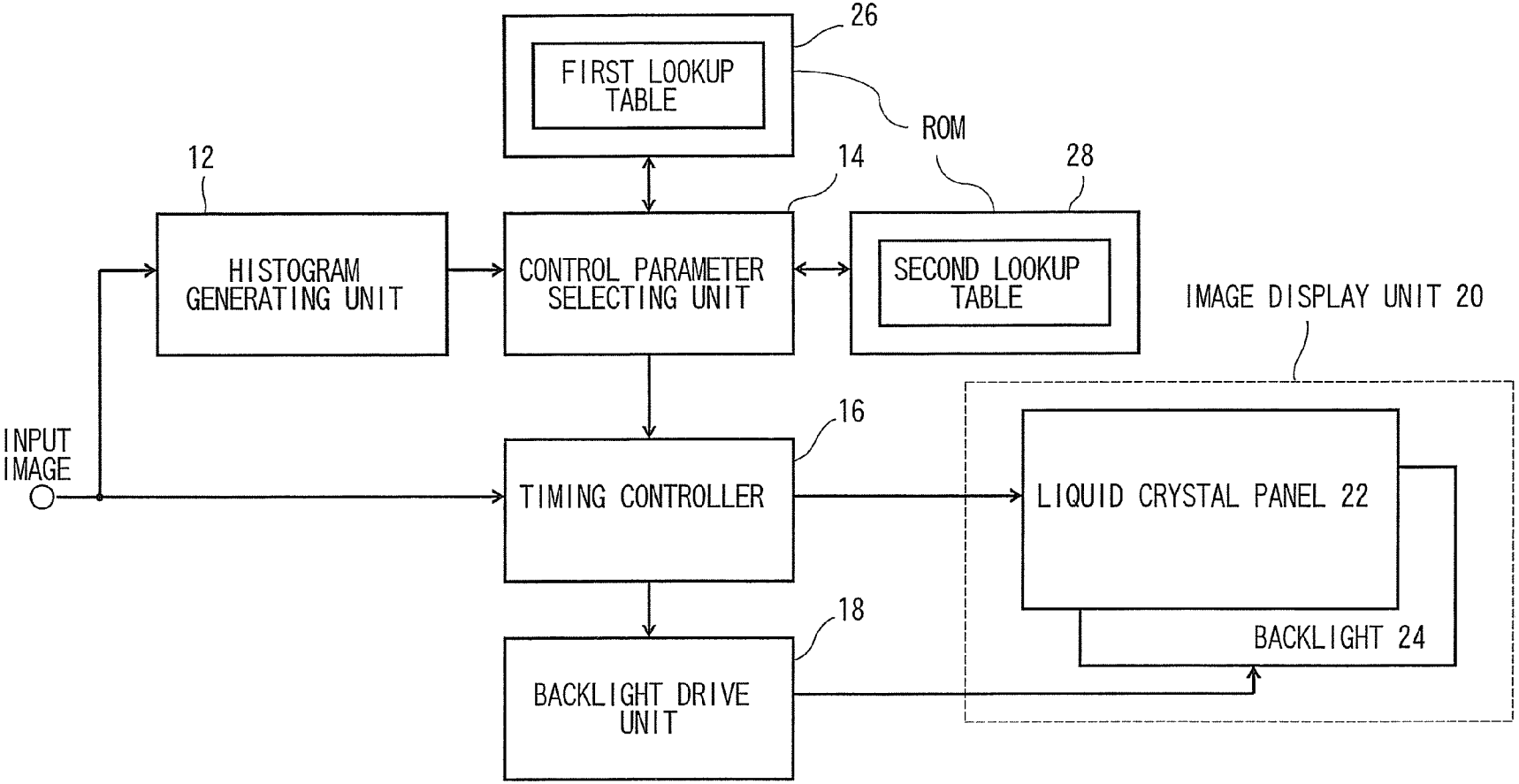
FIG. 13 is a block diagram of the image display apparatus with the first and second lookup tables added thereto.

The configuration shown in FIG. 13 is the configuration shown in FIG. 7 further including a lookup table having the gray-scale level conversion functions $f_i(x)$ added thereto. An example of the second lookup table 28 is shown in FIG. 14.

In an evaluation value update step described later, the output gray-scale level $f_i(x)$ is obtained by referring to the second lookup table 28 for the preset gray-scale level x and the output gray-scale level conversion selection number i.

(3-4) Initialization Step 2

In Initialization Step 2, a first evaluation value $E_1$ and a second evaluation value $E_2$ used in the evaluation value update step described later are initialized as shown in Expression 18.

$$E_1 \leftarrow 0$$

$$E_2 \leftarrow 0 \tag{18}$$

(3-5) Evaluation Value Update Step

In the evaluation value update step, the first evaluation value E1 and the second evaluation value E2 are calculated in a first evaluation value calculating step and a second evaluation value calculating step, respectively.

(3-5-1) First Evaluation Value Calculating Step

Figure 15:
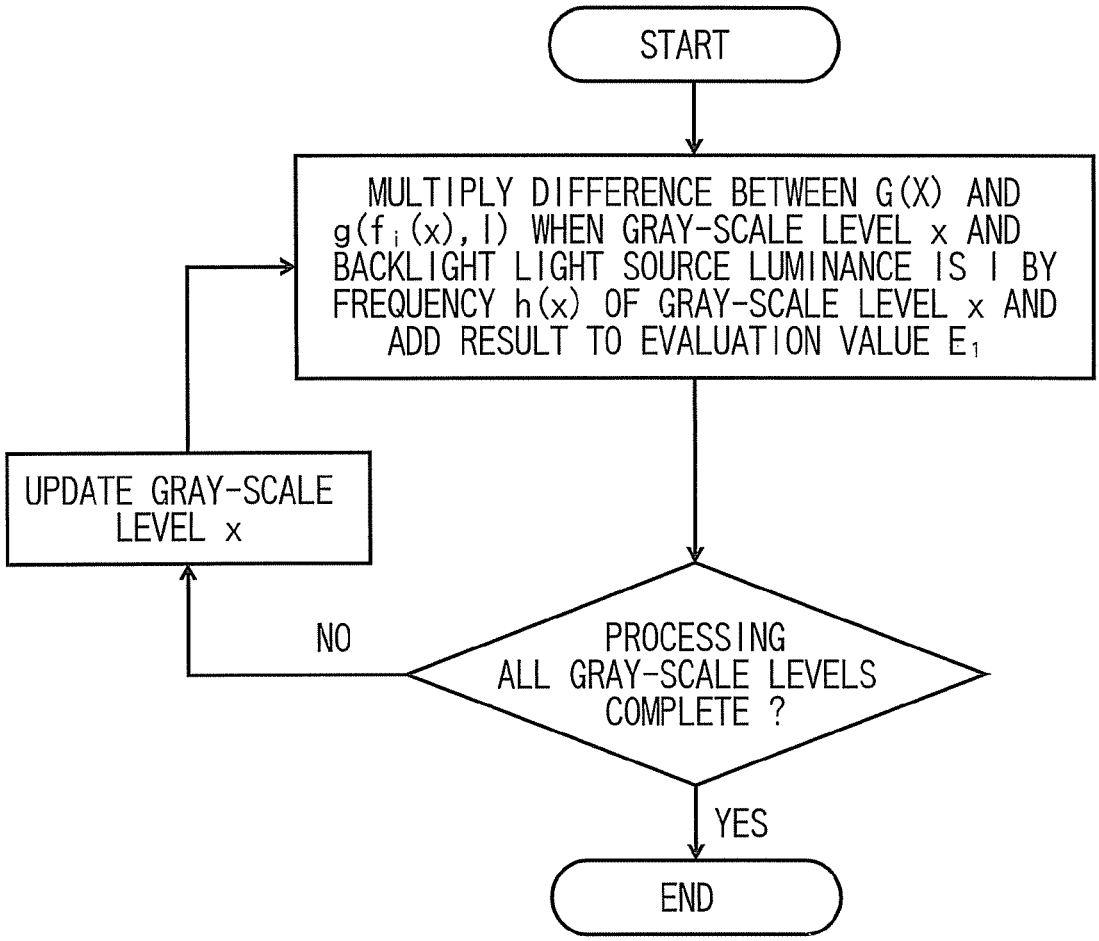
FIG. 15 is a flowchart of a first evaluation value calculating step.

Referring to a flowchart in FIG. 15, operation of the first evaluation value calculating step will be described.

Firstly, the brightness G(x) in the maximum dynamic range in the case of the current preset gray-scale level x is obtained.

Then, the gray-scale level conversion function $f_i(x)$ which the output gray-scale level conversion selection number indicates for the preset gray-scale level x is obtained.

Then, the brightness $g(f_i(x), I)$ in the image display unit 20 for the gray-scale level conversion function $f_i(x)$ and the backlight luminance I is obtained.

Then, the difference value between the G(x) and $g(f_i(x), I)$ is calculated.

Then, the calculated difference value is multiplied by the frequency h(x) of the preset gray-scale level x obtained by the histogram generating unit 12, and the product is added to the evaluation value $E_1$.

For example, when the difference value is evaluated on the basis of an absolute difference value, it is expressed as Expression 19.

$$E_1 \leftarrow E_1 + |G(x) - g(f_i(x), I)| h(x) \tag{19}$$

When the difference value is evaluated on the basis of a squared error, it is expressed as Expression 20.

$$E_1 \leftarrow E_1 + \{G(x) - g(f_i(x), I)\}^2 h(x) \tag{20}$$

In Expression 19 and Expression 20, the gray-scale level/brightness characteristic is used for evaluation. However, the gray-scale level/brightness characteristic which has been set in Step 1 and Step 2 may be utilized. When using the gray-scale level/lightness value characteristic for example, in the case that the difference value is evaluated on the basis of the squared error, it is expressed as Expression 21.

$$E_1 \leftarrow E_1 + \{G_{L^*}(x) - g_{L^*}(f_i(x), I)\}^2 h(x) \tag{21}$$

It is also possible to employ a configuration that a weight is added to the value of h(x) obtained by the histogram generating unit 12 in the first evaluation value calculating step. For example, when the update of the first evaluation value is carried out by Expression 19, it is expressed as follows.

$$E_1 \leftarrow E_1 + |G(x) - g(f_i(x), I)| h(x)^{\alpha} \tag{22}$$

where α is a weight to be added by power to the frequency h(x) of the preset gray-scale level x. Although various powers may be taken as the value of α, it is empirically confirmed to take values between 0 and 1.

After having ended the calculation of the first evaluation value for the current preset gray-scale level x, whether the calculation of the first evaluation value for all the preset gray-scale levels x is ended or not is determined. If not, the preset gray-scale levels x are updated, and the first evaluation value calculating step is executed again. For example, when the histogram obtained by the histogram generating unit 12 is the frequency obtained for every gray-scale level from 0 to 255, whether or not the preset gray-scale level x is 255 or higher is determined first. If it is smaller than 255, the preset gray-scale level x is incremented by one and the preset gray-scale level x is updated.

(3-5-2) Second Evaluation Value Calculating Step

Figure 16:
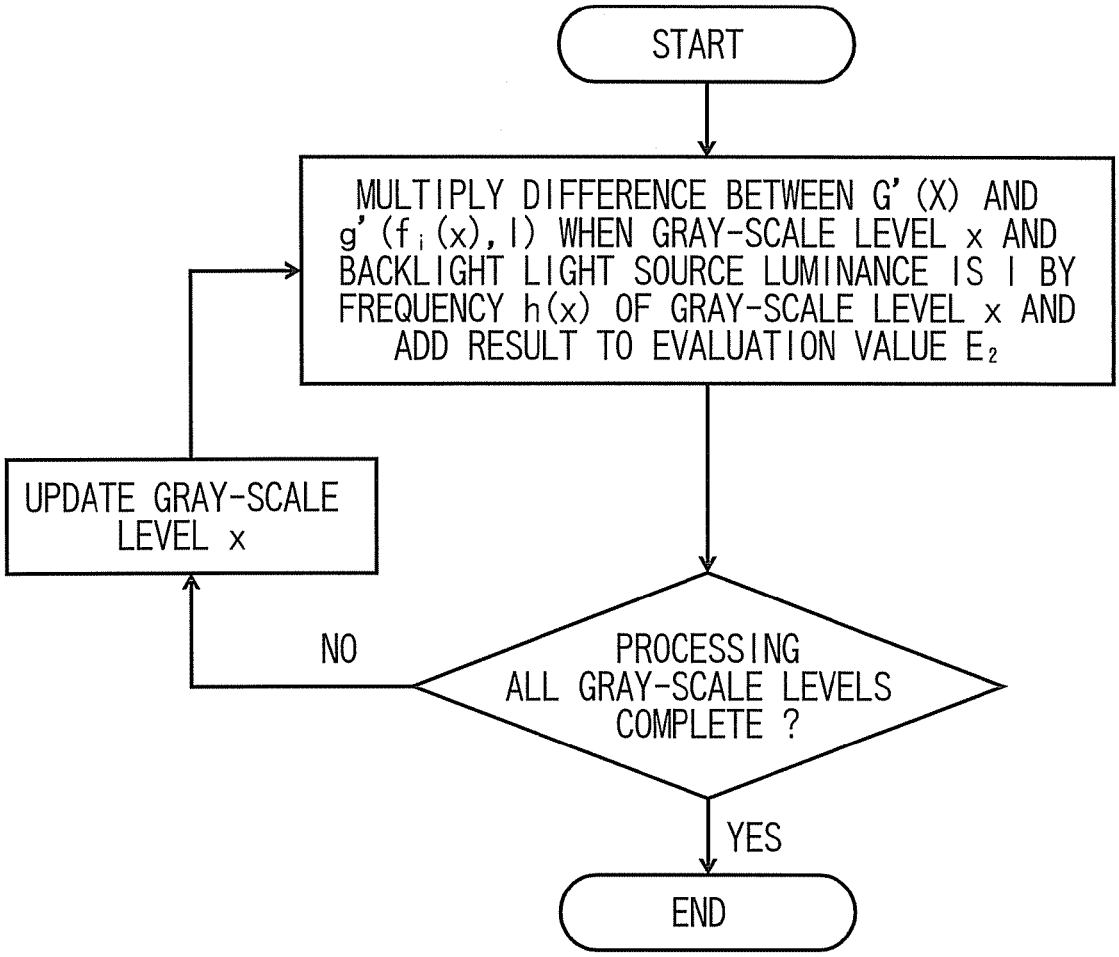
FIG. 16 is a flowchart of a second evaluation value calculating step.

Referring now to a flowchart shown in FIG. 16, operation of the second evaluation value calculating step will be described.

Firstly, the brightness gradient G'(x) in the maximum dynamic range in the case of the current preset gray-scale level x and the backlight luminance I is obtained.

Then, the gray-scale level conversion function $f_i(x)$ which the output gray-scale level conversion selection number i indicates for the preset gray-scale level x is obtained.

Then, the brightness gradient g' ($f_i(x)$, I) in the image display unit 20 for the gray-scale level conversion function $f_i(x)$ and backlight luminance I is obtained.

Then, the difference value between the G' (x) and g' ($f_i(x)$, I) is calculated.

Then, the calculated difference value is multiplied by the frequency h(x) of the preset gray-scale level x obtained by the histogram generating unit 12, and the product is added to the evaluation value $E_2$.

For example, when the difference value is evaluated on the basis of the absolute difference value, it is expressed as Expression 23.

$$E_1 \leftarrow E_2 + |G'(x) - g'(f_i(x), I)| h(x) \tag{23}$$

When the difference value is evaluated on the basis of the absolute difference value, it is expressed as Expression 24.

$$E_2 \leftarrow E_2 + \{G'(x) - g'(f_i(x), I)\}^2 h(x) \tag{24}$$

In Expression 23 and Expression 24, the gray-scale level/brightness gradient characteristic is used for evaluation. However, the gray-scale level/brightness characteristic which has been set in Step 1 and Step 2 may be utilized. When using the gray-scale level/lightness value gradient characteristic, in the case that the difference value is evaluated on the basis of the squared error, it is expressed as Expression 25.

$$E_2 \leftarrow E_2 + \{G_{L^*}'(x) - g_{L^*}'(f_i(x), I)\}^2 h(x) \tag{25}$$

It is also possible to employ a configuration that a weight is added to the value of h(x) obtained by the histogram generating unit 12 in the second evaluation calculating step. For example, when the update of the second evaluation value is carried out by Expression 23, it is expressed as follows.

$$E_2 \leftarrow E_2 + |G'(x) - g'(f_i(x), I)| h(x)^{\beta} \tag{26}$$

where β is a weight to be added by power to the frequency h(x) of the preset gray-scale level x. Although various powers may be taken as the value of β, it is empirically confirmed to take values between 0 and 1.

After having ended the calculation of the second evaluation value for the current preset gray-scale level x, whether the calculation of the second evaluation value for all the preset gray-scale levels x is ended or not is determined. If not, the preset gray-scale levels x are updated, and the second evaluation value calculating step is executed again. For example, when the histogram obtained by the histogram generating unit 12 is the frequency obtained for every gray-scale level from 0 to 255, whether or not the preset gray-scale level x is 255 or higher is determined first. If it is smaller than 255, the preset gray-scale level x is added by one, and the preset gray-scale level x is updated.

(3-5-3) Calculation of Evaluation Value E

After having calculated the first evaluation value $E_1$ and the second evaluation value $E_2$, the evaluation value E is calculated by a weighted linear sum as shown in Expression 27 for the first evaluation value and the second evaluation value.

$$E \leftarrow \lambda E_1 + (1-\lambda) E_2 \tag{27}$$

where λ is a weight of the first evaluation value and the second evaluation value, and is a value falling within a range from 0 to 1.

(3-6) Control Parameter Update Step

In the control parameter update step, whether the evaluation value E obtained in the evaluation value update step for the current backlight luminance I and the gray-scale level conversion function $f_i(x)$ is the minimum value or not is determined. If it is the minimum, the minimum evaluation value $E_{min}$ is updated to the current evaluation value E, with the current backlight luminance I fixed as the output backlight luminance $I_{opt}$ and the output gray-scale level conversion selection number i which indicates the current gray-scale level conversion function $f_i(x)$ fixed as $i_{opt}$.

Then, whether the evaluation of the gray-scale level conversion functions for all the preset output gray-scale level conversion selection number is ended or not is determined. If not, the value i is incremented by 1 and the output gray-scale level conversion selection number is revised.

When it is ended, whether the evaluation for all the preset values of backlight luminance I is ended or not is determined. If not, the backlight luminance I is updated, and the procedure returns back to Initialization Step 2 again.

For example, when the range of modulation of the backlight luminance is from $I_{min}$ into $I_{max}$ at an increment of 0.1, and if the current backlight luminance I is smaller than $I_{max}$, the backlight luminance I is incremented by 0.1 and the backlight luminance I is updated.

When it is ended, the output backlight luminance $I_{opt}$ and the output gray-scale level conversion selection number $i_{opt}$ at that time are outputted from the control parameter selecting unit 14.

(3-7) First Evaluation Value $E_1$, Second Evaluation Value $E_2$ and Evaluation Value E The first evaluation value $E_1$, the second evaluation value $E_2$ and the evaluation value E will now be described.

The first evaluation value $E_1$ indicates the similarity between the brightness which is wanted to be displayed on the image display unit 20 and the actual brightness of the image display unit 20 with the current backlight luminance I and the gray-scale level conversion function $f_i(x)$. In other words, it indicates that the similarity between the brightness which is wanted to be displayed on the image display unit 20 and the actual brightness of the image display unit 20 increases with decrease of the first evaluation value $E_1$.

The second evaluation value $E_2$ indicates the similarity between the brightness gradient which is wanted to be displayed on the image display unit 20 and the actual brightness gradient of the image display unit 20 with the current backlight luminance I and the gray-scale level conversion function $f_i(x)$ In other words, it indicates that the similarity between the brightness gradient which is wanted to be displayed on the image display unit 20 (the difference in brightness between adjacent gray-scale levels, contrast) and the actual brightness gradient which is wanted to be displayed on the image display unit 20 (the difference in brightness between adjacent gray-scale levels, contrast) increases with decrease of the second evaluation value $E_2$.

The evaluation value E is a weighted linear sum of the first evaluation value $E_1$ and the second evaluation value $E_2$, and is a value calculated by considering the balance of the two evaluation values shown above. In other words, it indicates that the first evaluation value $E_1$ and the second evaluation value $E_2$ decrease at a certain balance with decrease of the evaluation value E, and that both of the brightness and brightness gradient which are wanted to be displayed on the image display unit 20 are similar to the actual brightness and brightness gradient of the image display unit 20.

(4) Timing Controller 16

The timing controller 16 generates a conversion image signal by applying the gray-scale level conversion function fixed by the control parameter selecting unit 14 to the input image signal and controls the timing of a conversion image signal to be sent to the liquid crystal panel 22 and a backlight luminance signal to be sent to the backlight drive unit 18.

(4-1) Gray-Scale Level Conversion Method (Gamma Conversion Method)

A gray-scale level conversion method will now be described.

Figure 17:
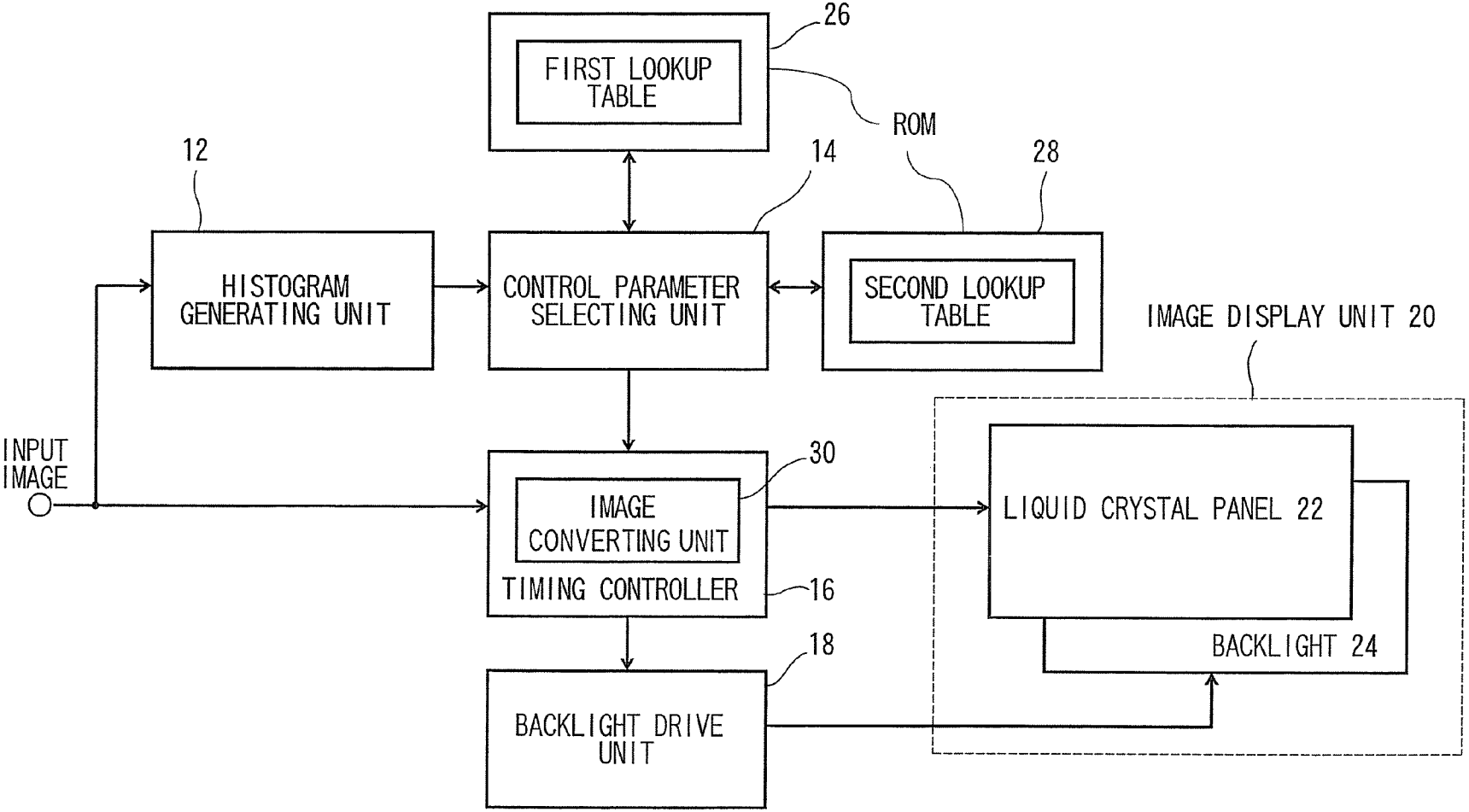
FIG. 17 is a block diagram of the image display apparatus with the first and second lookup tables and the image converting unit added thereto.

In a case that the control parameter selecting unit 14 converts the input image signal by the selected gray-scale level conversion function stored in the second lookup table 28 as shown in FIG. 13, a configuration of the image display apparatus 10 in the first embodiment will be shown in FIG. 17. The timing controller 16 includes an image converting unit 30 in the interior thereof.

The image converting unit 30 refers to the second lookup table 28 for the output gray-scale level conversion selection number $i_{opt}$ fixed by the control parameter selecting unit 14 to apply the corresponding gray-scale level conversion function to the input image. In other words, a processing of Expression 28 is executed for a gray-scale level L(u, v) of the input image at a horizontal pixel position u and a vertical pixel position v.

$$L_{out}(u,v)=f_{i_{opt}}(L(u,v)) \tag{28}$$

where $L_{out}$ (u, v) is a converted gray-scale level of a pixel of the input image at a position (u, v). The processing of Expression 28 is executed for all the pixels in the one frame of the input image, so that the input image is converted.

(4-2) Timing Control

Subsequently, the timing control will be described.

Since the histogram generating unit 12 generates the histogram by scanning all the pixels of the input image in the one frame as a basic operation thereof, the timing at which the image is input to the timing controller 16 and the timing at which the backlight luminance of the same image is input by the control parameter selecting unit 14 are different from each other by one frame period or more.

Therefore, in order to adjust delay of the timing as described above, the timing controller 16 delays the timing to output the input image using, for example, a frame buffer to synchronize with the output of the backlight luminance signal.

In this configuration, an input image and the timing to output the backlight luminance calculated from the input image are synchronized. However, in general, since the input image has a temporal continuity to a certain extent, for example, a configuration in which the backlight luminance I(n) obtained from the input image of the $n^{th}$ frame is synchronized with the input image of the $n+1^{th}$ frame may also be employed.

In other words, the backlight luminance is delayed by one frame period for an image which is actually displayed in the image display unit 20. In this case, it is not necessary to delay the input image significantly by the timing controller 16, and hence the amount of memory may be reduced.

(4-3) Others

The timing controller 16 also generates various synchronizing signals (horizontal synchronizing signal, vertical synchronizing signal) which are required for driving the liquid crystal panel 22, and sends to the liquid crystal panel 22 together with the conversion image converted by the image converting unit 30.

(5) Backlight Drive Unit 18

The backlight drive unit 18 generates the backlight drive signal for actually emitting the backlight 24 on the basis of the backlight luminance signal outputted from the timing controller 16.

The backlight drive signal differs depending on the type of the light source installed in the backlight 24. The light source of the backlight 24 of the liquid crystal display device generally used is a cold-cathode fluorescent lamp or a light-emitting diode (LED). These light sources are adapted to be able to modulate the luminance thereof by controlling the voltage and the current to be applied thereto.

In general, a PWM (Pulse Width Modulation) control for modulating the luminance by rapidly switching emitting periods and non-emitting periods is used.

In the first embodiment, the LED light source which is relatively easy to control the intensity of emitted light is employed as a light source of the backlight 24, and a configuration in which the luminance of the LED light source is modulated by the PWM control is employed. Therefore, the backlight drive unit 18 generates a PWM control signal on the basis of the backlight luminance signal to send to the backlight 24.

(6) Image Display Unit 20

As described above, the image display unit 20 includes the liquid crystal panel 22 as the light modulating unit and the backlight 24 installed on the back surface of the liquid crystal panel 22, which is capable of modulating the luminance of the light source.

The image display unit 20 writes the converted image signal outputted from the timing controller 16 to the liquid crystal panel 22 (light modulating device). The control parameter selecting unit 14 turns on the backlight 24 by the backlight drive signal outputted from the backlight drive unit 18 on the basis of the backlight luminance signal calculated by the control parameter selecting unit 14. Accordingly, the input image is displayed. As described above, in the first embodiment, the LED light source is employed as the light source of the backlight 24.

(7) Advantages

As described above, according to the first embodiment, the image display apparatus 10 which provides a superior visual contrast and reduced power consumption is provided.

Second Embodiment

A basic configuration of the image display apparatus 10 according to a second embodiment of the invention is the same as the first embodiment. However, the second embodiment is characterized in that the amount of variation of the backlight luminance among the frames is limited in the control parameter selecting unit 14.

(1) Limitation in Amount of Variation of Luminance

The control parameter selecting unit 14 in the second embodiment calculates the output backlight luminance $I_{opt}$ as in the first embodiment, and limits the variation in the backlight luminance among the frames with the processing shown below.

$$I_{opt}(t) = \begin{cases} I_{opt}(t-1) + \mathrm{sgn}(I_{opt}(t) - I_{opt}(t-1))T_I & |I_{opt}(t) - I_{opt}(t-1)| > T_I \\ I_{opt}(t) & \text{otherwise} \end{cases} \quad (29)$$

However, $$\mathrm{sgn}(a) = \begin{cases} -1 & a < 0 \\ 1 & a > 0 \\ 0 & a = 0 \end{cases} \quad (30)$$

where, $I_{opt}(t)$ is the output backlight luminance at a time t, and $T_I$ is a limit width of variation.

In other words, Expression 29 indicates that the amount of variations is limited to $T_I$ when the backlight luminance varies more than $T_I$ among frames.

With this processing, significant variation of the backlight luminance among frames of the input image is limited and, consequently, blink (flicker) generated in the image display unit 20 due to excessive variation in backlight luminance is restrained.

(2) Scene Change Detecting Unit 32

However, with the configuration described above, the amount of variation in backlight luminance is limited also when the displayed image is significantly changed among frames due to scene change and, consequently, the change in backlight luminance may be significantly delayed with respect to the displayed image.

Figure 18:
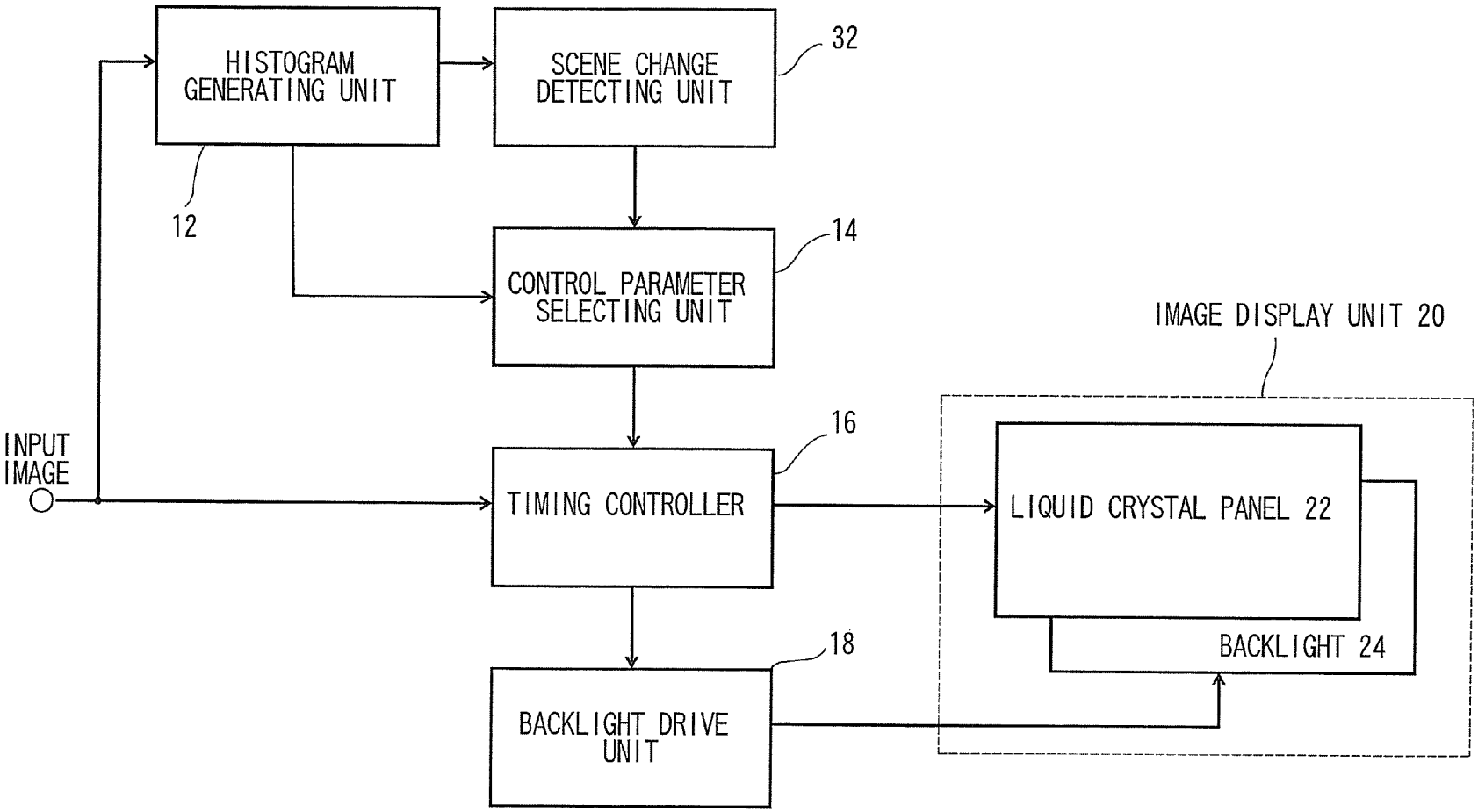
FIG. 18 is a block diagram of the image display apparatus with the first and second lookup tables and a scene change detection unit added thereto.

Therefore, as shown in FIG. 18, it is preferable to provide a scene change detecting unit 32 for controlling the amount of variation in backlight luminance among frames on the basis of the result of scene change detection.

Various methods are conceivable for detecting the scene change by the scene change detecting unit 32. However, in the second embodiment, a method of detecting using the histogram detected from the temporally adjacent two frames is employed. The scene change is detected using Expression 31 with a frequency of the preset gray-scale level x at the time t of h(x, t).

$$s(t) = \begin{cases} 1 & \sum_{x=0}^{255} |h(x, t) - h(x, t-1)| > T_s \\ 0 & \text{otherwise} \end{cases} \quad (31)$$

where s (t) is the result of scene change detection at the time t, 1 represents the scene change, 0 represents no scene change, and $T_s$ is a threshold value for determining the scene change.

With the result of the scene change detection, the limit width $T_I$ of the variation is controlled as shown below.

$$T_I = \begin{cases} T_I & s(t) = 0 \\ \alpha T_I & \text{otherwise} \end{cases} \quad (32)$$

where $\alpha$ is a positive real number larger than 1 and $T_I(t)$ is a limit width of the amount of change in backlight luminance among frames at the time t.

In other words, when it is no scene change (s (t)=0), the same limit width $T_I$ as Expression 29 is used. In contrast, when it is the scene change (s(t)=1), the limit width is larger than $T_I$ obtained by multiplying the limit width $T_I$ by a coefficient of $\alpha$. The processing of Expression 29 using the limit width $T_I(t)$ obtained by Expression 32 causes the variation in backlight luminance to follow the change in scene when the backlight luminance is significantly changed at the time of the scene change.

(3) Modification 1

In the second embodiment shown above, a configuration in which the variation of the output backlight luminance is limited after having calculated the output backlight luminance with respect to the input image is employed. However, other configurations are also conceivable.

For example, in the first embodiment, the evaluation value E is calculated entirely for the predetermined backlight luminance modulating range $I_{min}$ into $I_{max}$ in the control parameter update step to fix the output backlight luminance. However, with a configuration in which the range of the backlight luminance to be evaluated is limited to a portion near the output backlight luminance of one frame before, excessive variation in output backlight luminance among frames may be limited.

In other words, $I_{min}$ is set in substitution of the initial value of the backlight luminance I in the initializing step 1 at the time t in the first embodiment. However, in this embodiment, the modification is made as follows.

$$I \leftarrow I_{opt}(t-1) - T_I \quad (33)$$

where $i_{opt}(t-1)$ shows an output backlight luminance at a time t−1. However, when the value of I is smaller than $I_{min}$, I is corrected to $I_{min}$.

(4) Modification 2

Furthermore, in the determination whether the processing of the entire backlight luminance modulation range is terminated or not in the control parameter update step, whether or not it is smaller than the maximum value $I_{max}$ in the modulation range is determined in the first embodiment. However, in this embodiment, whether or not I is smaller than $I_{opt}(t-1)+T_I$ and smaller than $I_{max}$ is determined, and when it is established, the backlight luminance is updated and the procedure returns back to the initializing step 2. When it is not established, modification is made to terminate the processing.

With this configuration, the backlight luminance is evaluated only in a range of $\pm T_I$ with respect to the output backlight luminance $I_{opt}$ (t−1) in the previous frame. Therefore, the output backlight luminance $I_{opt}(t)$ is also fixed to this range. Consequently, the temporal variation in output backlight luminance may be limited.

In this configuration as well, it is possible to combine the scene change detection and, in this case, a configuration in which $T_I$ is obtained using Expression 32 is applicable.

Modification

The invention is not limited to the embodiments shown above, and various modifications can be made without departing from the scope of the invention.

For example, the embodiment of the transmissive liquid crystal display apparatus with the combination of the liquid crystal panel 22 and the backlight 24 has been described as a configuration of the image display unit 20. However, this embodiment is also applicable to various configurations of the image display unit 20 other than the transmissive liquid crystal display apparatus.

For example, it is also applicable to the projection type image display unit 20 having the liquid crystal panel 22 as the light modulating device combined with a light source such as a halogen lamp.

The projection system image display unit 20 in which halogen lamp as the light source and a digital micro mirror device that displays an image by controlling the reflection of light from the halogen lamp as the light modulating device are used may also be applicable.

What is claimed is:

1. An image display apparatus comprising:

an image display unit having a light source configured to be able to adjust the light source luminance in n steps from dark luminance to bright luminance and a light modulating unit configured to display an image by modulating the transmittance or the reflectance of light from the light source on the basis of an input image signal;

a histogram generating unit configured to generate a histogram which correlates representative gray-scale levels which are representatives of respective gray-scale level ranges divided at every predetermined number of gray-scale levels in one frame of an input image to frequencies of pixels included in the respective gray-scale level ranges;

a function generating unit configured to generate predetermined m types of gray-scale level conversion functions for converting predetermined j preset gray-scale levels into output gray-scale levels which can be displayed by the light modulating unit;

a first brightness calculating unit configured to calculate predetermined values of first brightness of the respective j preset gray-scale levels;

a second brightness calculating unit configured to calculate second values of brightness to be displayed on the image display unit at the respective output gray-scale levels obtained by converting the respective preset gray-scale levels in each combination of the j preset gray-scale levels, the n steps of light source luminance and the m types of gray-scale level conversion functions;

a first difference calculating unit configured to calculate first differences between the first values of brightness and the second values of brightness in each combination of the j preset gray-scale levels, the n steps of light source luminance and the m types of gray-scale level conversion functions;

a first multiplying unit configured to calculate first products multiplying the first differences by the frequencies for the respective representative gray-scale levels corresponding to the preset gray-scale levels used for calculating the first differences;

a first summation calculating unit configured to calculate first evaluation values, which are sums of the first products for the all j preset gray-scale levels;

a first brightness gradient calculating unit configured to calculate predetermined values of first brightness gradient of the respective j preset gray-scale levels;

a second brightness gradient calculating unit configured to calculate second values of brightness gradient to be displayed on the image display unit at the respective output gray-scale levels obtained by converting the respective preset gray-scale levels in each combination of the j preset gray-scale levels, the n steps of light source luminance and the m types of gray-scale level conversion functions;

a second difference calculating unit configured to calculate second differences between the first values of brightness gradient and the second values of brightness gradient in each combination of the j preset gray-scale levels, the n steps of light source luminance and the m types of gray-scale level conversion functions;

a second multiplying unit configured to calculate second products multiplying the second differences by the frequencies for the respective representative gray-scale levels corresponding to the preset gray-scale levels used for calculating the second differences;

a second summation calculating unit configured to calculate second evaluation values, which are sums of the second products for the all j preset gray-scale levels;

a weighted linear sum calculating unit configured to calculate weighted linear sums of the first evaluation values and the second evaluation values in each combination of the n steps of light source luminance and the m types of gray-scale level conversion functions;

a determination unit configured to determine the weighted linear sum which is equal to or smaller than a predetermined threshold value or the minimum value from among the respective weighted linear sums;

a control parameter selecting unit configured to select an optimum light source luminance and an optimum gray-scale level conversion function corresponding to the determined weighted linear sum; and a control unit configured to provide a converted image converted from the input image by the optimum gray-scale level conversion function to the light modulating unit and set the light source to emit light at the optimum light source luminance for one frame of the input image.

2. The apparatus according to claim 1, wherein the first multiplying unit multiplies the first differences for the respective preset gray-scale levels by values obtained by raising the frequencies of the preset gray-scale levels in the histogram to an $\alpha^{th}$ power ($\alpha$ is an actual value larger than zero), and the second multiplying unit multiplies the second differences for the respective preset gray-scale levels by values obtained by raising the frequencies of the preset gray-scale levels in the histogram to a $\beta^{th}$ power ($\beta$ is an actual value larger than zero).

3. The apparatus according to claim 1, wherein the m types of gray-scale level conversion functions generated by the function generating unit differ from each other for the respective steps of light source luminance divided into n steps.

4. The apparatus according to claim 3, wherein the m types of gray-scale level conversion functions generated by the function generating unit are such that the inclination of the output gray-scale level with respect to the preset gray-scale level on the low gray-scale level side increases with decrease of the brightness of the light source luminance.

5. The apparatus according to claim 3, wherein the m types of gray-scale level conversion functions generated by the function generating unit are such that the inclination of the output gray-scale level with respect to the preset gray-scale level on the high gray-scale level side increases with increase of the brightness of the light source luminance.

6. The apparatus according to claim 1, wherein the function generating unit generates a plurality of gray-scale level conversion functions for the respective steps of the light source luminance divided into n steps.

7. The apparatus according to claim 1, comprising a first table data including the preset gray-scale levels in one-to-one correspondence with the predetermined values of brightness of the preset gray-scale levels, wherein the first brightness calculating unit refers to the first table data and calculates the first value of brightness, and wherein the first brightness gradient calculating unit refers to the first table data and calculates the difference between the brightness of the preset gray-scale level and the brightness of the gray-scale level adjacent to the preset gray-scale level as the first brightness gradient.

8. The apparatus according to claim 1, comprising a second table data including the preset gray-scale levels in one-to-one correspondence with the values of output levels obtained by converting the preset gray-scale levels by the gray-scale level conversion functions, wherein the second brightness calculating unit refers to the second table data and obtains the second value of brightness, and wherein the second brightness gradient calculating unit refers to the second table data and calculates the difference between the brightness of the preset gray-scale level and the brightness of the gray-scale level adjacent to the preset gray-scale level as the second brightness gradient.

9. The apparatus according to claim 1, comprising a third table data including the output gray-scale levels in one-to-one correspondence with the values of brightness to be displayed on the image display unit at the output gray-scale levels obtained by illuminating the light modulating unit at the respective steps of light source luminance divided into n steps, wherein the second value of brightness calculating unit refers to the third table data and calculates the second brightness to be displayed on the image display unit at the output gray-scale level obtained by illuminating the light modulating unit at the one light source luminance, and wherein the second brightness gradient calculating unit refers to the third table data and calculates the difference between the brightness to be displayed on the image display unit at the output gray-scale level obtained by illuminating the light modulating unit at the one light source luminance and the brightness of to be displayed on the image display unit at the gray-scale level adjacent to the output gray-scale level obtained by illuminating the light modulating unit at the one light source luminance as the second brightness gradient.

10. An image display method that displays an input image on an image display unit having a light source configured to be able to adjust the light source luminance in n steps from dark luminance to bright luminance and a light modulating unit configured to display an image by modulating the transmittance or the reflectance of light from the light source on the basis of an input image signal, comprising:

a step of generating a histogram which correlates representative gray-scale levels which are representatives of respective gray-scale level ranges divided at every predetermined number of gray-scale levels in one frame of an input image to frequencies of pixels included in the respective gray-scale level ranges;

a step of generating predetermined m types of gray-scale level conversion functions for converting predetermined j preset gray-scale levels into output gray-scale levels which can be displayed by the light modulating unit;

a step of calculating predetermined values of first brightness of the respective j preset gray-scale levels;

a step of calculating second values of brightness to be displayed on the image display unit at the respective output gray-scale levels obtained by converting the respective preset gray-scale levels in each combination of the j preset gray-scale levels, the n steps of light source luminance and the m types of gray-scale level conversion functions;

a step of calculating first differences between the first values of brightness and the second values of brightness in each combination of the j preset gray-scale levels, the n steps of light source luminance and the m types of gray-scale level conversion functions;

a step of calculating first products multiplying the first differences by the frequencies for the respective representative gray-scale levels corresponding to the preset gray-scale levels used for calculating the first differences;

a step of calculating first evaluation values, which are sums of the first products for the all respective j preset gray-scale levels;

a step of calculating predetermined values of first brightness gradient of the respective j preset gray-scale levels;

a step of calculating second values of brightness gradient to be displayed on the image display unit at the respective output gray-scale levels obtained by converting the respective preset gray-scale levels in each combination of the j preset gray-scale levels, the n steps of light source luminance and the m types of gray-scale level conversion functions;

a step of calculating second differences between the first values of brightness gradient and the second values of brightness gradient in each combination of the j preset gray-scale levels, the n steps of light source luminance and the m types of gray-scale level conversion functions;

a step of calculating second products multiplying the second differences by the frequencies for the respective representative gray-scale levels corresponding to the preset gray-scale levels used for calculating the second differences;

a step of calculating second evaluation values, which are sums of the second products for the all respective j preset gray-scale levels;

a step of calculating weighted linear sums of the first evaluation values and the second evaluation values in each combination of the n steps of light source luminance and the m types of gray-scale level conversion functions;

a step of determining the weighted linear sum which is equal to or smaller than a predetermined threshold value or the minimum value from among the respective weighted linear sums;

a step of selecting an optimum light source luminance and an optimum gray-scale level conversion function corresponding to the determined weighted linear sum; and a step of providing a converted image converted from the input image by the optimum gray-scale level conversion function to the light modulating unit and setting the light source to emit light at the optimum light source luminance for one frame of the input image.

11. The method according to claim 10, wherein the step of calculating first products multiplies the first differences for the respective preset gray-scale levels by values obtained by raising the frequencies of the preset gray-scale levels in the histogram to an $\alpha^{th}$ power ($\alpha$ is an actual value larger than zero), and the step of calculating second products multiplies the second differences for the respective preset gray-scale levels by values obtained by raising the frequencies of the preset gray-scale levels in the histogram to a $\beta^{th}$ power ($\beta$ is an actual value larger than zero).

12. The method according to claim 10, wherein the m types of gray-scale level conversion functions generated in the step of generating the m types of gray-scale level conversion functions differ from each other for the respective steps of light source luminance divided into n steps.

13. The method according to claim 12, wherein the m types of gray-scale level conversion functions generated in the step of generating the m types of gray-scale level conversion functions are such that the inclination of the output gray-scale level with respect to the preset gray-scale level on the low gray-scale level side increases with decrease of the brightness of the light source luminance.

14. The method according to claim 12, wherein the m types of gray-scale level conversion functions generated in the step of generating the m types of gray-scale level conversion functions are such that the inclination of the output gray-scale level with respect to the preset gray-scale level on the high gray-scale level side increases with increase of the brightness of the light source luminance.

15. The method according to claim 10, wherein the step of generating the m types of gray-scale level conversion functions generates a plurality of gray-scale level conversion functions for the respective steps of the light source luminance divided into n steps.

16. An image display program being stored in a non-transitory computer readable storage medium and displaying an input image on an image display unit having a light source configured to be able to adjust the light source luminance in n steps from dark luminance to bright luminance and a light modulating unit configured to display an image by modulating the transmittance or the reflectance of light from the light source on the basis of an input image signal, the program comprising:

an instruction of generating a histogram which correlates representative gray-scale levels which are representatives of respective gray-scale level ranges divided at every predetermined number of gray-scale levels in one frame of an input image to frequencies of pixels included in the respective gray-scale level ranges;

an instruction of generating predetermined m types of gray-scale level conversion functions for converting predetermined j preset gray-scale levels into output gray-scale levels which can be displayed by the light modulating unit;

an instruction of calculating predetermined values of first brightness of the respective j preset gray-scale levels;

an instruction of calculating second values of brightness to be displayed on the image display unit at the respective output gray-scale levels obtained by converting the respective preset gray-scale levels in each combination of the j preset gray-scale levels, the n steps of light source luminance and the m types of gray-scale level conversion functions;

an instruction of calculating first differences between the first values of brightness and the second values of brightness in each combination of the j preset gray-scale levels, the n steps of light source luminance and the m types of gray-scale level conversion functions;

an instruction of calculating first products multiplying the first differences by the frequencies for the respective representative gray-scale levels corresponding to the preset gray-scale levels used for calculating the first differences;

an instruction of calculating first evaluation values, which are sums of the first products for the all j preset gray-scale levels;

an instruction of calculating predetermined values of first brightness gradient of the respective j preset gray-scale levels;

an instruction of calculating second values of brightness gradient to be displayed on the image display unit at the respective output gray-scale levels obtained by converting the respective preset gray-scale levels in each combination of the j preset gray-scale levels, the n steps of light source luminance and the m types of gray-scale level conversion functions;

an instruction of calculating second differences between the first values of brightness gradient and the second values of brightness gradient in each combination of the j preset gray-scale levels, the n steps of light source luminance and the m types of gray-scale level conversion functions;

an instruction of calculating second products multiplying the second differences by the frequencies for the respective representative gray-scale levels corresponding to the preset gray-scale levels used for calculating the second differences;

an instruction of calculating second evaluation values, which are sums of the second products for the all j preset gray-scale levels;

an instruction of calculating weighted linear sums of the first evaluation values and the second evaluation values in each combination of the n steps of light source luminance and the m types of gray-scale level conversion functions;

an instruction of determining the weighted linear sum which is equal to or smaller than a predetermined threshold value or the minimum value from among the respective weighted linear sums;

an instruction of selecting an optimum light source luminance and an optimum gray-scale level conversion function corresponding to the determined weighted linear sum; and an instruction of providing a converted image converted from the input image by the optimum gray-scale level conversion function to the light modulating unit and setting the light source to emit light at the optimum light source luminance for one frame of the input image.

17. The program according to claim 16, wherein the instruction of calculating first products multiplies the first differences for the respective preset gray-scale levels by values obtained by raising the frequencies of the preset gray-scale levels in the histogram to an $\alpha^{th}$ power ($\alpha$ is an actual value larger than zero), and the instruction of calculating second products multiplies the second differences for the respective preset gray-scale levels by values obtained by raising the frequencies of the preset gray-scale levels in the histogram to a $\beta^{th}$ power ($\beta$ is an actual value larger than zero).

18. The program according to claim 16, wherein them types of gray-scale level conversion functions generated by the instruction of generating the m types of gray-scale level conversion functions differ from each other for the respective steps of light source luminance divided into n steps.

19. The program according to claim 18, wherein the m types of gray-scale level conversion functions generated by the instruction of generating the m types of gray-scale level conversion functions are such that the inclination of the output gray-scale level with respect to the preset gray-scale level on the low gray-scale level side increases with decrease of the brightness of the light source luminance.

20. The program according to claim 18, wherein the m types of gray-scale level conversion functions generated by the step of generating the m types of gray-scale level conversion functions are such that the inclination of the output gray-scale level with respect to the preset gray-scale level on the high gray-scale level side increases with increase of the brightness of the light source luminance.

21. The program according to claim 16, wherein the instruction of generating the m types of gray-scale level conversion functions generates a plurality of gray-scale level conversion functions for the respective steps of the light source luminance divided into n steps.

* * * * *